US009618860B2

(12) United States Patent
Parsapour et al.

(10) Patent No.: US 9,618,860 B2
(45) Date of Patent: Apr. 11, 2017

(54) ELECTROPHOTOGRAPHIC PRINTER PHOTOCONDUCTOR BASED ON LIGAND-FREE SEMICONDUCTOR QUANTUM DOTS

(71) Applicant: BROTHER INTERNATIONAL CORPORATION, Bridgewater, NJ (US)

(72) Inventors: Farzad Parsapour, Bartlett, TN (US); Rodney Loyd, Cordova, TN (US); Juzo Kuriyama, Germantown, TN (US)

(73) Assignee: Brother International Corporation, Bridgewater, NJ (US)

( * ) Notice: Subject to any disclaimer, the term of this patent is extended or adjusted under 35 U.S.C. 154(b) by 0 days.

(21) Appl. No.: 14/616,316

(22) Filed: Feb. 6, 2015

(65) Prior Publication Data

US 2015/0301462 A1 Oct. 22, 2015

Related U.S. Application Data

(60) Provisional application No. 61/936,520, filed on Feb. 6, 2014, provisional application No. 62/013,228, filed on Jun. 17, 2014.

(51) Int. Cl.

| | |
|---|---|
| ***G03G 5/082*** | (2006.01) |
| ***G03G 5/087*** | (2006.01) |
| ***G03G 5/08*** | (2006.01) |
| ***B05D 1/00*** | (2006.01) |
| ***B05D 1/42*** | (2006.01) |
| ***G03G 5/047*** | (2006.01) |
| ***G03G 5/05*** | (2006.01) |
| ***G03G 5/10*** | (2006.01) |

(52) U.S. Cl.

CPC ..... *G03G 5/087* (2013.01); *B05D 1/005* (2013.01); *B05D 1/42* (2013.01); *G03G 5/047* (2013.01); *G03G 5/0525* (2013.01); *G03G 5/08* (2013.01); *G03G 5/102* (2013.01)

(58) Field of Classification Search

CPC ..... G03G 5/082; G03G 5/047

See application file for complete search history.

(56) References Cited

U.S. PATENT DOCUMENTS

| | | | | |
|---|---|---|---|---|
| 2005/0201149 | A1 | 9/2005 | Duan et al. | |
| 2010/0090195 | A1 | 4/2010 | Parsapour | |
| 2013/0026445 | A1 | 1/2013 | Parsapour | |
| 2015/0220008 | A1* | 8/2015 | Parsapour ..... | G03G 5/087 430/57.1 |

FOREIGN PATENT DOCUMENTS

| | | |
|---|---|---|
| WO | WO 2012/013272 | 2/2012 |

OTHER PUBLICATIONS

International Search Report and a Written Opinion for PCT/IB2015/000909 Sep. 29, 2015.

* cited by examiner

*Primary Examiner* — Hoa V Le

(74) *Attorney, Agent, or Firm* — Haug Partners LLP

(57) ABSTRACT

A photoconductor and method of forming a photoconductor for an electrophotographic device comprising forming a charge generation material comprising a plurality of quantum dots, and forming an active region comprising one or more photoconductor layers comprising the charge generation material including the surface modified quantum dots.

39 Claims, 19 Drawing Sheets

◇ : QD (CGM)

▲ : Hole Transport Material (HTM)

⬡ : Electron Transport Material (ETM)

▤ : Polymer Matrix

ELECTROPHOTOGRAPHIC PRINTER PHOTOCONDUCTOR BASED ON LIGAND-FREE SEMICONDUCTOR QUANTUM DOTS

CROSS-REFERENCE TO RELATED APPLICATIONS

This application claims the benefit of priority to U.S. Provisional Patent Application No. 61/936,520, filed Feb. 6, 2014, and to U.S. Provisional Patent Application No. 62/013,228, filed Jun. 17, 2014, both are hereby incorporated herein by reference in their entireties.

FIELD OF THE INVENTION

The present invention relates to photoconductor for electrophotographic printing devices.

BACKGROUND

Electrophotographic printing is a non-impact printing technology invented by Chester Carlson in the 1930s. It occupies a large segment of the total printing market, with a global market value of $59.9 billion in 2009. Electrophotographic printing is a highly complex printing technology consisting of 2 core components, namely the photoconductor (PC) and the toner. The printing process involves 7 distinct steps, which include PC charging, PC exposure, toner development, toner transfer, fusing, cleaning, and charge erasure. The photoconductor, as a primary component, is involved in 6 of the 7 aforementioned steps. Thus, both photoconductor durability and performance are highly sought-after characteristics.

An example of a process applied for forming images by electrophotography using these photoconductors is the Carlson process, named after Chester Carlson. In this process, image formation is carried out by charging the photoconductor by corona discharge in the dark, forming an electrostatic latent image such as characters or pictures of a copy on the surface of the charged photoconductor, developing the formed electrostatic latent image with toner, and fixing the developed toner image on a carrier such as paper, and following transfer of the toner image, the photoconductor is reused after carrying out erase, removal of residual toner and optical erase.

The photoconductor is the component through which a latent image can be formed, with the latent image being developed by toner particles in the subsequent step. Initially, an electrostatic charge is distributed through projection on the surface of the PC. Next, light exposure results in generation of charge carriers within the PC and through absorption of light by the CGM. The charge carriers are transported to the PC surface and the opposite electrode by CTM. As the charge carriers reach the surface, they neutralize surface charges within the area previously illuminated. This forms a latent image on the surface of the PC, which can then be subjected to toner development.

Photoconductors are required to retain surface charge in the dark, and must be able to transport a charge by absorbing light. Single-layer photoconductors possess both of these functions in a single layer of the photoconductuor. Multilayer photoconductors separate these functions into separate layers: a charge generation layer and a layer that retains the surface charge in the dark and transports the charge during absorption of light.

Photoconductor performance relies on several factors, including charge acceptance during projection of charge on PC surface, free charge generation and transport following illumination, and the degree of surface charge neutralization. All these factors work in concert to exemplify the overall performance of a photoconductor. The performance is typically measured in terms of sensitivity of the photoconductor to light exposure at a particular wavelength, with higher photosensitivities associated with enhanced PC performance. Additionally, the performance can be measured in terms of the rate of photodischarge of the photoconductor once illuminated with light of specific wavelength, with higher discharge rates associated with a better photoconductor.

Of special importance is the charge generation material (CGM) incorporated in a photoconductor. Desired CGM characteristics include efficient absorption of light at the exposure wavelength, low recombination of initially-generated charges, the ability to produce free charges and transfer charges to transport material, and photostability. As such, both the optical/electronic properties of the CGM and manipulation of these properties through the choice of correct material and environment are of utmost importance. In addition, PCs are required to be manufactured in a cost-effective manner, so to reduce the overall cost of the printing device.

Current photoconductors utilize dyes such as diazo or phthalocyanine compounds and derivatives as CGM. These compounds are readily available and have been produced and used as CGMs in electrophotographic printer's photoconductors extensively. Nevertheless, research and development of novel CGMs have been ongoing, due to the need for charge generation material with increased photoresponse (resulting in higher printing speed), and higher photostability (resulting in longer lifetime).

BRIEF SUMMARY OF THE INVENTION

Disclosed are embodiments of a quantum dot photoconductor (QDPC) for an electrophotographic device comprising: at least one conductive layer and; an active region comprising at least one photoconductor layer comprising: a charge generation material (CGM) comprising a plurality of surface modified quantum dots (QD), wherein the quantum dots are formed by replacement of an initial capping layer with a substantially different capping layer through exchange of long-chain organic ligand forming the initial capping layer with small organic molecules, and substantial removal of the final capping layer from the QDs at elevated temperatures under reduced pressure after the QDPC device for the electrophotographic device has been fabricated. The device can further comprise the quantum dots including quantum dots selected from the group of: size-dependent quantum dots, composition-dependent quantum dots, core-shell quantum dots, alloyed core quantum dots, alloyed core-shell quantum dots, doped quantum dots, InP/ZnS core-shell quantum dots, CdS, CdSe, ZnS, ZnSe, GaN, GaP, InP, InN, PbSe, PbS, Ge, CuI, Copper Indium Gallium Disulfide (CIGS), Si, CdSSe, and ZnS:Mn doped quantum dots. The photoconductor can comprise: the conductive layer comprising a conductive substrate selected from the group of: aluminum plates and cylinders, a non-conductive substrate coated with a conductive material, aluminum-coated Mylar or PET, and nickel-coated Mylar or PET. The conductive layer can comprise aluminum.

Described are embodiments of a method of forming a QD photoconductor material comprising surface modified quantum dots for an electrophotographic device comprising: replacing an initial capping layer of quantum dots (QDs) with a substantially different final capping layer through an exchange of long-chain organic ligands forming the initial QD capping layer with small organic molecules, and removing substantially all of the final capping layer from the QDs. The method can further comprise: forming a QDPC comprising the charge generation material comprising the QD's having the capping layer removed; and heating the QDPC under reduced pressure. The method can comprise: dissolving a QD sample comprising the QDs with the initial capping layer in a solvent to form a QD solution, wherein the solvent comprises smaller ligands than the ligands forming the initial capping layer; refluxing the QD solution; precipitating the refluxed QD solution with a precipitant to induce precipitation of ligand-exchanged quantum dots; separating and removing a liquid phase supernatant liquid including the excess ligands from the refluxed QD solution to afford a QD solid wherein the QDs include the final small-ligand capping layer.

According to an embodiment, the method can further comprise: repeating the dissolution, precipitation, and liquid phase removal a plurality of times. The solvent for dissolving the QD solid can comprise pyridine wherein and the precipitant can comprise hexane. The method can comprise adding a solution of N,N'-Diphenyl-N,N.-di(3-tolyl)-4-benzidine (TPD) to the ligand-exchanged QD solid to form a QD/TPD dispersion, and adding a polymer to the QD/TPD dispersion to form the QDPC photoconductor material.

The method can comprise: preparing a QDPC formulation by mixing QD sample including long-chain ligands forming the capping layer with the pyridine; and placing the QD mixture in a reflux apparatus and refluxing the QD mixture under a flow of argon for a period of 12-120 hours at a temperature of 85-130 degrees Celsius, whereby the initial long-chain ligands are exchanged with the final capping layer including small organic ligands on the surface of the QDs. The method can comprise the QD sample including InP QD; the initial capping layer comprising myristic acid ligands; and the final capping layer comprising pyridine.

The method can comprise: fabricating a QDPC device from the QD photoconductor material. The method can comprise preparing a substrate for QDPC layer deposition; forming a ground electrode on the substrate; depositing a layer of the QDPC material on the substrate; and drying the substrate. Forming the QDPC material can comprise: dispersing the ligand exchanged QD solid with a solution of N,N'-Diphenyl-N,N'-di(3-tolyl)-4-benzidine (TPD); adding a polymer to the QD/TPD dispersion. The method can comprise depositing a layer of the QDPC material on an substrate comprising aluminum. The method can comprise refluxing the QD solution in an inert atmosphere. The polymer can comprise polystyrene. The QDPC material can comprise at least 2.5 mg of QD solid. The QDPC material can comprise: at least from 2.5 mg of QD solid to about 20 mg QD solid.

According to various embodiments of the present application, the photoconductor device can comprise an active region comprising at least two photoconductor layers comprising a Charge Generation Layer (CGL) and a Charge Transport Layer (CTL); a charge generation material (CGM) comprising the plurality of substantially ligand-free quantum dots, and a Charge Transport Layer (CTL) comprising a Charge Transport Material (CTM). The photoconductor can further comprise a polymeric material comprising a polymer matrix or resin or both, wherein the photoconductor is formed with at least one solution of polymeric material comprising the polymer matrix or resin or both, the solution further including at least one of the CGM or the CTM. In an embodiment, device can comprise a CGL formed from a polymer-free CGM solution. The CTM can be formed by dissolving a Hole Transport Material (HTM) in a solution of the polymeric material. In an embodiment, the photoconductor can comprise an under coat layer (UCL), wherein the UCL comprises a material for eliminating charge injection from the conductive substrate.

According to various embodiments of the present application, the charge generation layer is substantially free of polystyrene polymers, the charge generation layer has a thickness of about 20 nm to 1,000 nm, for example a thickness of about 200 nm, and/or the charge transport layer has a thickness a thickness of about 5 μm to about 35 μm, for example about 20 μm.

According to various embodiments of the present application, the charge generation layer includes polystyrene polymers, the charge generation layer has a thickness of about 200 nm to 10,000 nm, the charge generation layer has a thickness of about 200 nm to about 10,000 nm, for example 8,000 nm, and/or the charge transport layer has a thickness of about of about 5 μm to about 35 μm, for example 20 μm.

DETAILED DESCRIPTION

Figure 1A:
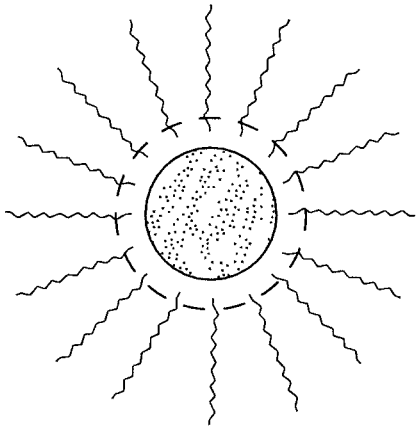
FIG. 1A depicts a 2-D pictorial of a quantum dot with organic ligand capping layer.

Semiconductor quantum dots have unique physical, chemical, electrical and optical properties. Optical and electrical characteristics stem from size-dependent properties owing to quantum confinement of charge carriers. This often results in the ability to "tune" the optical and electronic properties, specifically, light absorption, light emission, and the energetics involving charge generation and interaction, which can be modified through changing the size of the QD. As disclosed herein, due to the aforementioned unique photonic and electronic nature of the QDs, quantum dots also exhibit desired characteristics for use as CGM in photoconductors for electrophotography, including electrophotographic devices such as printers, scanners, or other electrophotographic imaging devices.

Typical colloidal quantum dot compositions including the type used as described herein, consist of an active inorganic core, for example InP, CuInS2, and Si shrouded by a capping layer composed of high boiling point, long aliphatic chain organic ligands, for example myristic acid (MA). The organic capping layer provides dispersability of the QD composition in various solvents and also acts as a stabilizing agent. The capping layer provides for solution-processing of the quantum dots and quantum dot formulations, and as such, it is an integral part of the colloidal system during initial processing steps. On the other hand, due to its large radius and electrically insulating nature, the capping layer provides a large barrier to charge transfer and transport, which may reduce the overall performance of the photoconductor for an eletrophotographic device. Therefore, there remains a need for modification of the surface of the QDs in the finalized QDPC device to minimize or remove the afore-mentioned barrier.

Disclosed are embodiments of QDPCs and methods for fabricating a photoconductor (PC) for an electrophotographic printing device including QDs wherein the QDs have substantially or effectively no capping layers. The photoconductor, designated hereafter as quantum dot photoconductor (QDPC), utilizes surface-modified semiconductor quantum dots (QD) as Charge Generation Material (CGM) within the photoconductor.

In embodiments, removal of the capping layer from the surface of the quantum dots can provide for the neighboring quantum dots to have intimate contact so to maximize charge carrier transport and mobility, and also provide for the removal of energetic barrier to charge transfer from quantum dots to charge transport materials (CTM), for example, to HTM or ETM.

In embodiments, removal may be accomplished through depopulation of the organic ligands forming the capping layer on the surface of the quantum dots by chemical means, as described herein. This depopulation may result in a decrease in inter-QD distance and also reduce the energetic barrier to QD to CTM charge transfer, hence enhancing both charge carrier mobility and charge transfer rate, respectively.

In embodiments, surface modification is achieved through depopulation of organic ligands forming the capping layer on the surface of quantum dots through chemical means.

FIG. 1A depicts a 2-D pictorial of a quantum dot with organic ligand capping layer.

Figure 1B:
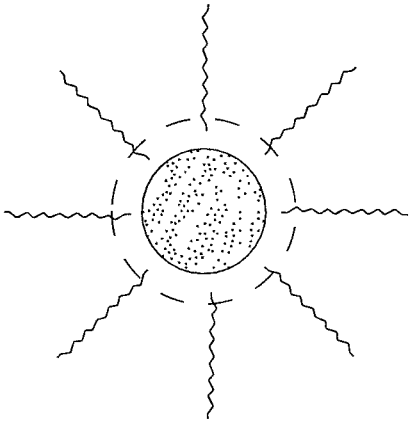
FIG. 1B exhibits the quantum dot of FIG. 1 following organic ligand depopulation through the methodology described for the exemplary device.

FIG. 1B exhibits the quantum dot of FIG. 1 following organic ligand depopulation through the methodology described below for the exemplary device.

In general, a quantum dot photoconductor can exhibit enhanced performance compared with a conventional organic photoconductor (OPC), including overall increase in printing speed and longer lifetime when integrated with an electrophotographic printing device. The performance enhancements arise due to intrinsically high optical absorption cross-section in quantum dots, manipulation of the position of electronic levels and energetics, a substantial presence of quasi solid-state charge transport, and intrinsically high photostability in an inorganic CGM as compared to an organic CGM. Further enhancement in performance is subsequently achieved through modification of the surface of QDs to afford more efficient charge transfer and charge transport. In various embodiments, the photoconductor utilizes a "Single-Layer" architecture that includes conventional HTM, the CGM (QD), additionally acting as Electron Transport Material (ETM), and a polymer. In various embodiments, the photoconductor is a "Dual-layer" architecture where a charge generation layer (CGL) includes the CGM (QD) and a separate charge transport layer (CTL) includes the HTM. The aforesaid method of fabrication and implementation are applicable to a wide range of quantum dots, including size-dependent or composition-dependent QDs of varying sizes and compositions, core, core-shell, alloyed core, and alloyed core-shell quantum dots.

Modification of the QD surface through depopulation of the organic ligands forming the capping layer on the surface of the quantum dots can result in more efficient charge transfer from QD (CGM) to HTM. Also, electron transport through the network of quantum dots may be enhanced due to depopulation of long chain ligands that inhibit charge transport. As noted above, due to higher optical absorption cross-section, QDs can absorb more photons under equal illumination compared with conventional CGMs. This in turn will result in more efficient exciton generation in QDs. As a result, the optical power output of the exposure source need not be increased to increase the photoresponse. In addition, generation of free charge carriers and charge transfer to transport molecules is expected to be more efficient due to the direct relationship between size and the position of the QD energy levels. Finally, utilization of semiconductor quantum dots as electron transport material can provide for a quasi-solid state transport scheme that may result in higher electron mobility compared with conventional CGM.

In embodiments, the minimization or removal of the capping layer of the QD is achieved through first, exchange of the initial capping layer comprising non-volatile ligands with a substantially different capping layer composed of semi-volatile ligands by utilizing a reflux process (ligand-exchange process), followed by substantial removal of the semi-volatile capping layer from the surface of the quantum dots after QDPC device fabrication by application of heat to the device under reduced pressure.

Accordingly, disclosed is a method for fabricating a QDPC for an electrophotographic image device utilizing substantially ligand-free semiconductor quantum dots (QD) as CGM within the photoconductor. Substantial removal of the ligands forming the capping layer on the surface of quantum dots is achieved through 2 inter-related steps:

(1) Exchange of the initial capping layer composed of nonvolatile organic ligands (the non-volatile capping layer)

with a different capping layer composed of semi-volatile organic ligands (the semi-volatile capping layer), and (2) Substantial removal of the semi-volatile capping layer from the active photoconductor layer after the fabrication of the QDPC device.

Figure 2A:
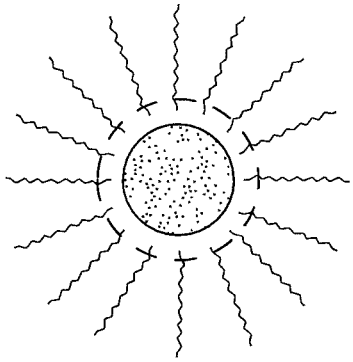
FIG. 2A depicts a 2-D pictorial of a quantum dot with organic ligand capping layer.

FIG. 2A depicts a 2-D pictorial of a quantum dot with organic ligand capping layer.

Figure 2B:
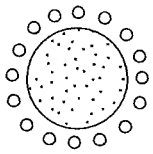
FIG. 2B exhibits the quantum dot of FIG. 2A following organic ligand exchange through the methodology described for the exemplary device.

FIG. 2B exhibits the quantum dot of FIG. 2A following organic ligand exchange through the methodology described for the exemplary device.

Figure 2C:
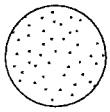
FIG. 2C exhibits a quantum dot without a surface capping layer or with the surface capping layer substantially removed.

FIG. 2C exhibits a quantum dot without a surface capping layer or with the surface capping layer substantially removed.

For the purposes of this disclosure, non-volatile capping layers are composed of organic ligands which cannot be removed (vaporized) from the active photoconductor layer through application of heat in a reduced pressure environment post QDPC device fabrication, without inflicting damage to the active photoconductor layer. In contrast, the semi-volatile capping layer is composed of organic molecules that may be removed by heating the QDPC device, post fabrication, in a reduced pressure environment, while maintaining the integrity of the active photoconductor layer.

It is to be understood that the figures and descriptions of the present invention have been simplified to illustrate elements that are relevant for a clear understanding of the present invention, while eliminating, for purposes of clarity, many other elements which are conventional in this art. QDs have been explored for their electroluminescent properties with applications in optoelectronics, particularly, as active emitting layers in planar light emitting devices. Quantum dots have also been studied for use in photovoltaics, specifically as the active layer in solar cells. Examples of such quantum dot optoelectronic devices, applications, methods and elements thereof are described in U.S. Pat. Nos. 5,889,288; 5,923,046; 5,963,571; 6,281,519; 6,239,449; 7,282,732; 7,358,525; 7,791,157; 7,829,880; 8,164,083, U.S. patent application Ser. Nos. 13/190,884, and 13/565,297 the entirety of each of which are incorporated by reference herein.

Quantum dots also exhibit desired characteristics for use as CGM in photoconductors. Typical colloidal quantum dot compositions including the type used in embodiments described herein, consist of an active inorganic core, for example InP or Si shrouded by an organic ligand capping layer, for example trioctylphosphine oxide (TOPO), or an active inorganic core encased by an inorganic shell, for example ZnS which is also shrouded by an organic ligand capping layer (core-shell structure). In general, core-shell structures possess increased stability and lower charge recombination rates due to elimination of the core surface defects by the shell moiety. The organic capping layer assists in enhancing the dispersability of the QD composition in various solvents and also acts as a stabilizing agent. As such, it is an integral part of the colloidal system during initial processing; however, it may be modified or removed afterward.

Conventional photoconductors utilize dyes such as diazo or phthalocyanine compounds and derivatives as CGM. These compounds are readily available and have been produced and used as CGMs in electrophotographic printer's photoconductors extensively. As noted herein, QDs are expected to absorb more photons under equal illumination as compared with conventional CGMs due to higher optical absorption cross section. This in turn will result in more efficient exciton generation in QDs. As a result, the optical power output of the exposure source need not be increased to increase the photoresponse. Also, spectral tenability in quantum dots affords matching of the optical absorption profile/peak to the wavelength of the incoming light, without changing the composition of the CGM material. In addition, generation of free charge carriers and charge transfer to transport molecules is expected to be more efficient due to the direct relationship between size and the position of the QD energy levels. The ability to control the QD surface will afford a path to enhancing charge generation and transfer as well. The above-mentioned enhancements should result in an overall improvement in photoconductor sensitivity, which in turn would translate to a higher printing speed. Also, due to their inorganic nature, semiconductor quantum dot CGMs are expected to be more photostable compared with their organic CGM counterparts.

Those of ordinary skill in the art will recognize that other elements are desirable for implementing the present invention. However, because such elements are well known in the art, and because they do not facilitate a better understanding of the present invention, a discussion of such elements is not provided herein.

The use of the terms "a", "an", "at least one", "one or more", and similar terms indicate one of a feature or element as well as more than one of a feature. The use of the term "the" to refer to the feature does not imply only one of the feature and element.

When an ordinal number (such as "first", "second", "third", and so on) is used as an adjective before a term, that ordinal number is used (unless expressly or clearly specified otherwise) merely to indicate a particular feature, such as to distinguish that particular feature from another feature that is described by the same term or by a similar term.

When a single device, article or other product is described herein, more than one device/article (whether or not they cooperate) may alternatively be used in place of the single device/article that is described. Accordingly, the functionality that is described as being possessed by a device may alternatively be possessed by more than one device/article (whether or not they cooperate). Similarly, where more than one device, article or other product is described herein (whether or not they cooperate), a single device/article may alternatively be used in place of the more than one device or article that is described. Accordingly, the various functionality that is described as being possessed by more than one device or article may alternatively be possessed by a single device/article.

The functionality and/or the features of a single device that is described may be alternatively embodied by one or more other devices, which are described but are not explicitly described as having such functionality/features. Thus, other embodiments need not include the described device itself, but rather can include the one or more other devices, which would in those other embodiments, have such functionality/features.

The present invention will now be described in detail on the basis of exemplary embodiments.

Incorporation of the semiconductor quantum dots as CGM in place of conventional organic-based dyes or pigments in the photoconductor results in the aforementioned enhancements. The aforesaid methods of fabrication and implementation are applicable to a wide range of quantum dots, including size-dependent or composition-dependent QDs of varying sizes and compositions, core, core-shell, alloyed core, alloyed core-shell quantum dots and doped quantum dots.

Disclosed are embodiments of a photoconductor comprising: at least one conductive layer and; an active region comprising at least one photoconductor layer comprising a charge generation material (CGM) comprising a plurality of quantum dots. The device can further comprise the quantum dots, examples of which include quantum dots selected from: size-dependent quantum dots, composition-dependent quantum dots, core-shell quantum dots, alloyed core quantum dots, alloyed core-shell quantum dots, InP/ZnS core-shell quantum dots, CdS, CdSe, ZnS, ZnSe, GaN, GaP, InP, InN, PbSe, PbS, Ge, CuI, Copper Indium Gallium Disulfide (CIGS), Si, CdSSe, and ZnS:Mn doped quantum dots. The quantum dots may be of core or core/shell structure, and include a layer of organic ligands on the surface to facilitate solution processing and dispersion stability, these ligands being processed as described in embodiments herein.

The photoconductor can also comprise materials selected from the group of materials including:

(1) Hole Transport Material (HTM), examples of which include but are not limited to: N,N'-Bis(3-methylphenyl)-N,N'-diphenylbenzidine, N,N'-Di-[(1-naphthyl)-N,N'-diphenyl]-1,1'-biphenyl)-4,4'-diamine, Tetra-N-phenylbenzidine, Tris[4-(diethylamino)phenyl]amine, N,N-diethylaminophenylbenzaldehyde-diphenylhydrazone, and other substituted Hydrazones.

(2) Electron Transport Material (ETM), examples of which include but are not limited to: Bathocuproine, Bathophenanthroline, 2,5-Bis(1-naphthyl)-1,3,4-oxadiazole, 3,5-Bis(4-tert-butylphenyl)-4-phenyl-4H-1,2,4-triazole, and Tris-(8-hydroxyquinoline)aluminum.

(3) Polymeric Material including a Polymer Matrix (PM) and/or Resins, examples of which include but are not limited to: Bisphenol-A-polycarbonate, Poly(methyl methacrylate), Polystyrene, Polyvinyl butyral, Polyester, and Polycarbonate-Z.

In embodiments disclosed herein, a photoconductor includes semiconductor quantum dots as its CGM.

Within the scope of the embodiments disclosed herein, non-volatile ligands refer to high-boiling point organic compounds with long aliphatic (hydrocarbon) chain within the backbone, examples of which include fatty acids and their amine and amide derivatives, more specifically, myristic acid, oleic acid, oleylamine, and oleamide. Other examples of non-volatile ligands include trioctylphosphire oxide. Semi-volatile ligands refer to low to medium boiling point organic compounds with single hydrocarbon ring or short chain structure, examples of which include pyridine, butylamine, and ethylthiol.

Figure 3A:
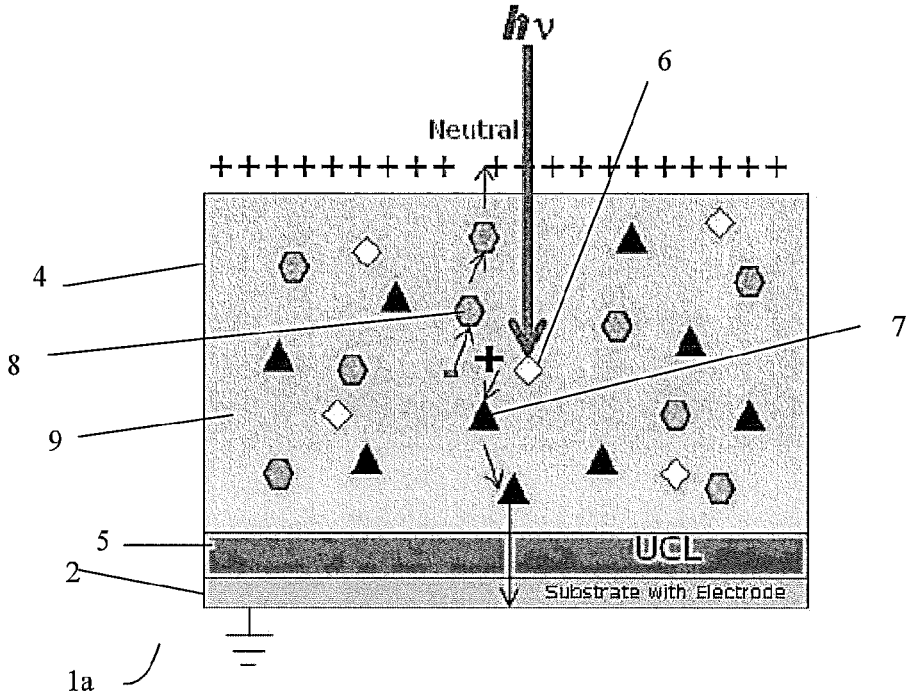
FIGS. 3A-3B depicts the general architecture of embodiments of the QDPC devices.

FIG. 3A depicts a schematic of an exemplary embodiment of a QDPC device 1*a*. In this embodiment, the QDPC 1*a* comprises a substrate comprising at least one electrical conducting layer 2, and an active region comprising at least one photoconductor layer 4 comprising quantum dots 6. Also shown is an optional undercoat layer 5.

The architecture includes an active region that may comprise at least one photoconductor layer that comprises CGM including quantum dots 6 within the device. The photoconductor's active region may also comprise a CTM 7, 8 within the device, for example, embedded within the active layer(s) 4. Illumination of the device 1*a* with light having a specific wavelength range results in generation of electron-hole pairs (excitons) within the active layer 4. Once generated, the excitons may diffuse through the active layer 4 and arrive at an interface (not shown) where the electrons and the holes can be separated.

Figure 3B:
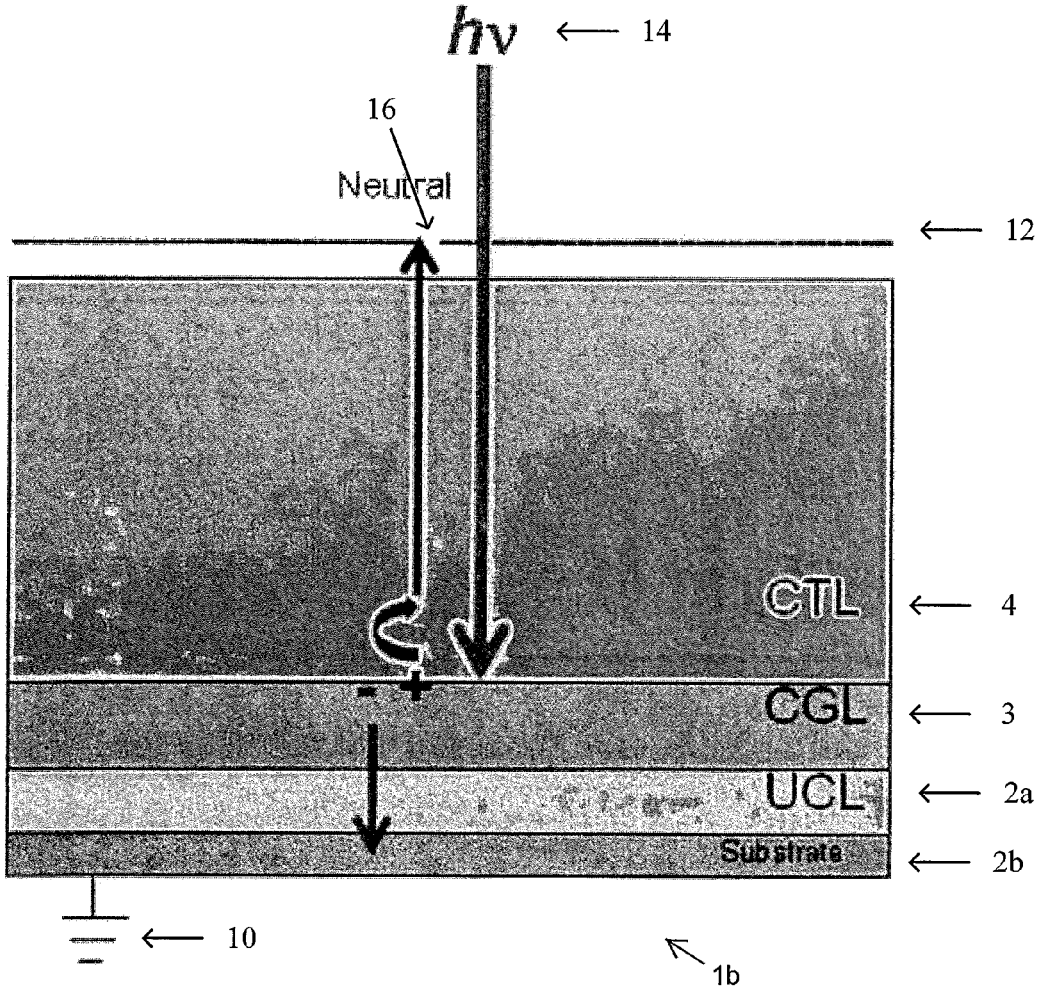

FIG. 3B depicts a general schematic of an exemplary dual-layer QDPC device 1*b*. In this embodiment, the QDPC 1*b* includes, the substrate 2*b* comprising at least one electrical conducting layer 2*b*, and an active region comprising a plurality of photoconductor layers 3, 4 including a charge generation layer (CGL) 3 comprising quantum dots and a charge transfer layer (CTL) 4 including charge transfer materials. The electrical conducting layer 2*b* can comprise a substrate made of a conductive material, or as shown in the embodiment, the electrical conducting layer 2*b* can comprise a substrate that may not itself be conductive (e.g., glass or Mylar or PET) but is coated with conductive material such as aluminum or nickel to render it conductive. The conductive substrate 2*b* can be framed by techniques known in the art, for example, e-beam or thermal evaporation. An optional undercoat layer 2*a* may also be included.

Accordingly the dual-layer architecture 1*b* includes a substrate 2*b* having a optional undercoat layer 2*a*. The general architecture 1*b* also includes a charge generation layer 3 deposited on the undercoat layer 2*a* and a charge transport layer 4 deposited on the charge generation layer 3. The substrate 2*b* is connected to a ground 10, and the device 1*b* can be charged to afford a surface potential. When exposed to a light or illumination 14, electron/hole pairs are generated in the charge generation layer 3. Electrons and holes are separated and are moved to the surface of the charge transport layer 4 and the substrate 2*b* respectively. The holes that reach the surface of the charge transport layer 4 neutralize the previously created negative charges 12 on the surface of the charge transport layer 4. The neutralized area 16 provides an area to be coated with toner.

According to an embodiment, the under coating layer 2*a* is optional, and additional layers can be added between the under coating layer 2*a* and the substrate 2*b*, between the charge generation layer 3 and the undercoat layer 2*a*, and between the charge generation layer 3 and the charge transport layer 4. According to an embodiment, this dual layer structure of a QDPC device may be used in embodimens where the charge generation layer is relatively thick.

Example 1

Fabrication of the Exemplary Devices

Disclosed are embodiments of the exemplary photoconductor devices utilizing surface-modified quantum dots as charge generation material (CGM), as for example depicted in FIGS. 1A-1B. Surface modification of the QDs is achieved through depopulation of the organic ligands forming the capping layer on the surface of the quantum dots through the methodology described below for the exemplary device.

In an embodiment for Example 1A, to prepare the QDPC formulation for the exemplary device, 100 ml of a solution of 25 mg/ml InP core QD sample in chloroform (with optical absorption onset of about 630 nm) having an organic capping layer was placed in an inert atmosphere—for example a glass vial inside an inert atmosphere glove box. The solvent was evaporated, affording 2.5 mg of QD solid sample.

The solid QD sample re-dissolved in 0.5 ml of chloroform, and 1.0 ml of methanol was added drop-wise to the dispersion to initiate precipitation of the QD solids. Following precipitation of the QDs in the solvent mixture, the vial containing the mixture was capped and removed from the glove box to ambient, and the sample was subjected to centrifugation at 4000 rpm for 120 minutes, resulting in full separation of solid and liquid phases. The liquid phase was then removed from the mixture, affording the solid QD. The process of dissolution-precipitation-liquid phase removal which is responsible for removal of ligands from the capping layer was repeated 2-8 additional times, following which the surface-depopulated QDs were recovered. As will be appreciated the dissolution-precipitation-liquid phase removal can be repeated any number of times, for example at least 2 to 12 times. The surface-depopulated QD solid was mixed with a 0.16 ml solution of N,N'-Diphenyl-N,N'-di(3-tolyl)-4-benzidine (TPD) in chloroform (105 mg/ml), and the mixture was stored in the glove box for 5-24 hours to allow full dispersion of QD solids in the liquid phase. Next, 0.29 ml of a 90 mg/ml solution of polystyrene (PS) in chloroform was added to the QD/TPD dispersion and stirred. Additionally, 0.05 ml of chloroform was added to the mixture and stirred, providing the QDPC formulation.

To prepare a substrate for QDPC layer deposition, a 75 mm×25 mm×1 mm glass slide was cleaned by ultrasonication in an isopropyl alcohol bath for 60 minutes and dried. A ground electrode was formed on the glass substrate through deposition of a 200 nm layer of aluminum (99.998%) on the glass slide via e-beam evaporation. The aluminum-deposited glass slide was then removed from the evaporator and used for QDPC device fabrication.

An exemplary single-layer QDPC device was fabricated by depositing a layer of QDPC on the aluminum-coated substrate utilizing the above-mentioned QDPC formulation. QDPC layer deposition was performed through blade-coating to afford a about 20 μm QDPC layer following drying in ambient conditions for 3-24 hours. The device was then placed in a photo-induced discharge measurement apparatus to characterize its performance. Typical photo-induced discharge characterization (PIDC) measurements were performed at an initial surface potential of +1000 V and illumination wavelength of 600 nm.

Fabrication of the Comparative Device

A comparative device was fabricated to confirm performance enhancement in the exemplary device of Example 1. For the standard device, a sample of InP core QD with the same initial characteristics was utilized; however, the QD sample was not subjected to depopulation of the organic ligands forming the capping layer on the surface of the quantum dots. In order to perform a valid comparison between the exemplary and the comparative device, all parameters, materials, and mixtures were kept identical.

Accordingly, to prepare the QDPC formulation for the standard comparative device, 100 μl of a solution of 25 mg/ml InP core QD sample in chloroform (with optical absorption onset of about 630 nm) having an organic capping layer was placed in a glass vial inside an inert atmosphere glove box. The solvent was evaporated, affording 2.5 mg of QD solid sample. However, the QD sample was not subjected to depopulation of the organic ligands forming the capping layer on the surface of the quantum dots. The QD solid was mixed with a 0.16 ml solution of N,N'-Diphenyl-N,N'-di(3-tolyl)-4-benzidine (TPD) in chloroform (105 mg/ml), and the mixture was stored in the glove box for 5-24 hours to allow full dispersion of QD solids in the liquid phase. Next, 0.29 ml of a 90 mg/ml solution of polystyrene (PS) in chloroform was added to the QD/TPD dispersion and stirred. Additionally, 0.05 ml of chloroform was added to the mixture and stirred, providing the QDPC formulation.

Accordingly, the same amounts of QD, TPD, and PS were used to afford the QDPC formulation for the standard device. The type of substrate and the method for deposition of the QDPC formulation for the standard device remained the same as well. Performance measurements were conducted using the same methodology as the previous example.

Example 1A as well as further Examples 1B and 1C of surface modified QDs achieved through depopulation of the organic ligands forming the capping layer on the surface of the quantum dots as shown above are given in Table 1. Samples of 200 μl of a solution of 25 mg/ml InP core QD sample were similarly processed to afford 5.0 mg of QD solid sample Examples 1B and 1C. The samples were similarly processed as given above.

TABLE 1

| | Component Mass (mg) | | | Component Ratio | | |
|---|---|---|---|---|---|---|
| Example | QD | HTM | Polymer | QD | HTM | Polymer |
| Example 1A E1A | 2.5 | 17 | 26 | 0.055 | 0.374 | 0.571 |
| Example 1B E1B | 5.0 | 17 | 26 | 0.104 | 0.354 | 0.542 |
| Example 1C E1C | 5.0 | 22 | 21 | 0.104 | 0.458 | 0.438 |

Figure 4A:
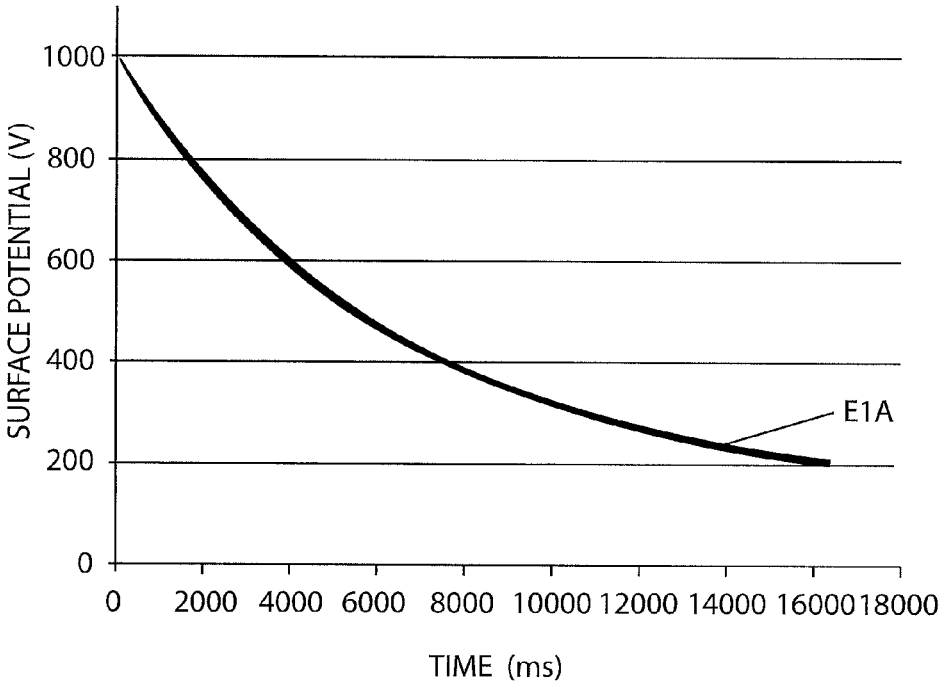
FIG. 4A exhibits the photo-induced discharge characteristic (PIDC) of an exemplary device comprising depopulated quantum dots.

FIG. 4A is a graph showing surface potential (V) over time of the exemplary device including showing the photo-induced discharge characteristic (PIDC) of the exemplary embodiment of the device for Example 1 E1A. The initial surface potential is charged by a Corona charger to +1000 V, and the device was illuminated with 600 nm monochromatic light. As shown in FIG. 4A, the surface potential drops from +1000 V to 200 V in 16,000 ms.

Figure 4B:
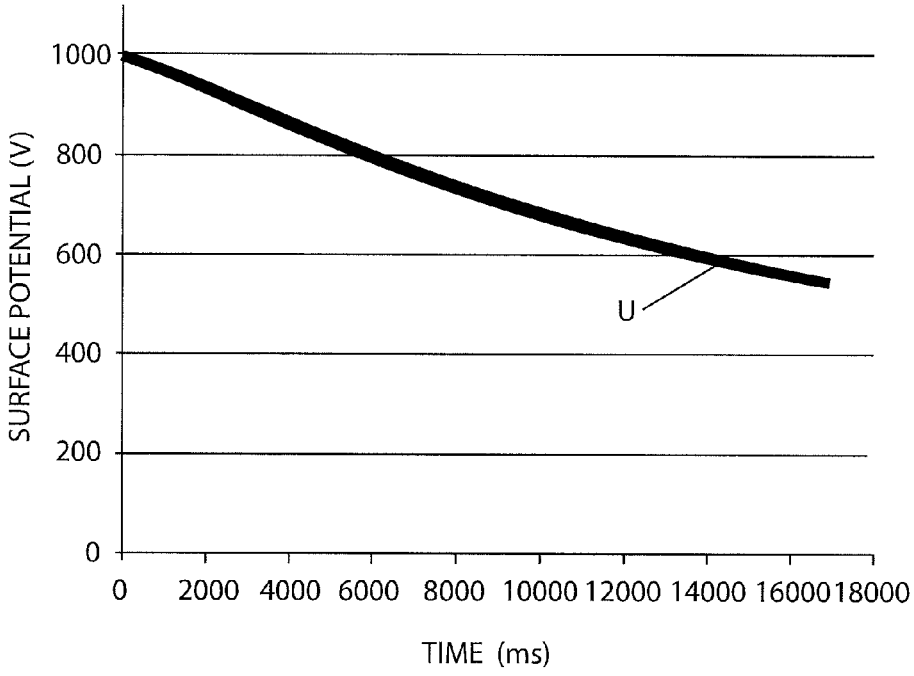
FIG. 4B depicts the PIDC of a comparative device comprising quantum dots where the capping layer is unprocessed.

FIG. 4B depicts the PIDC of the device where the QDs are unmodified U. Initial surface potential is at +1000 V, and the device was illuminated with 600 nm monochromatic light. However in the same amount of time the surface potential dropped from +1000 to just under 600 V, and the rate of drop being a substantially a regular slope. Thus the exemplary embodiment shows, inter alia, an exponentially increased photoresponse over the standard device.

Figure 4C:
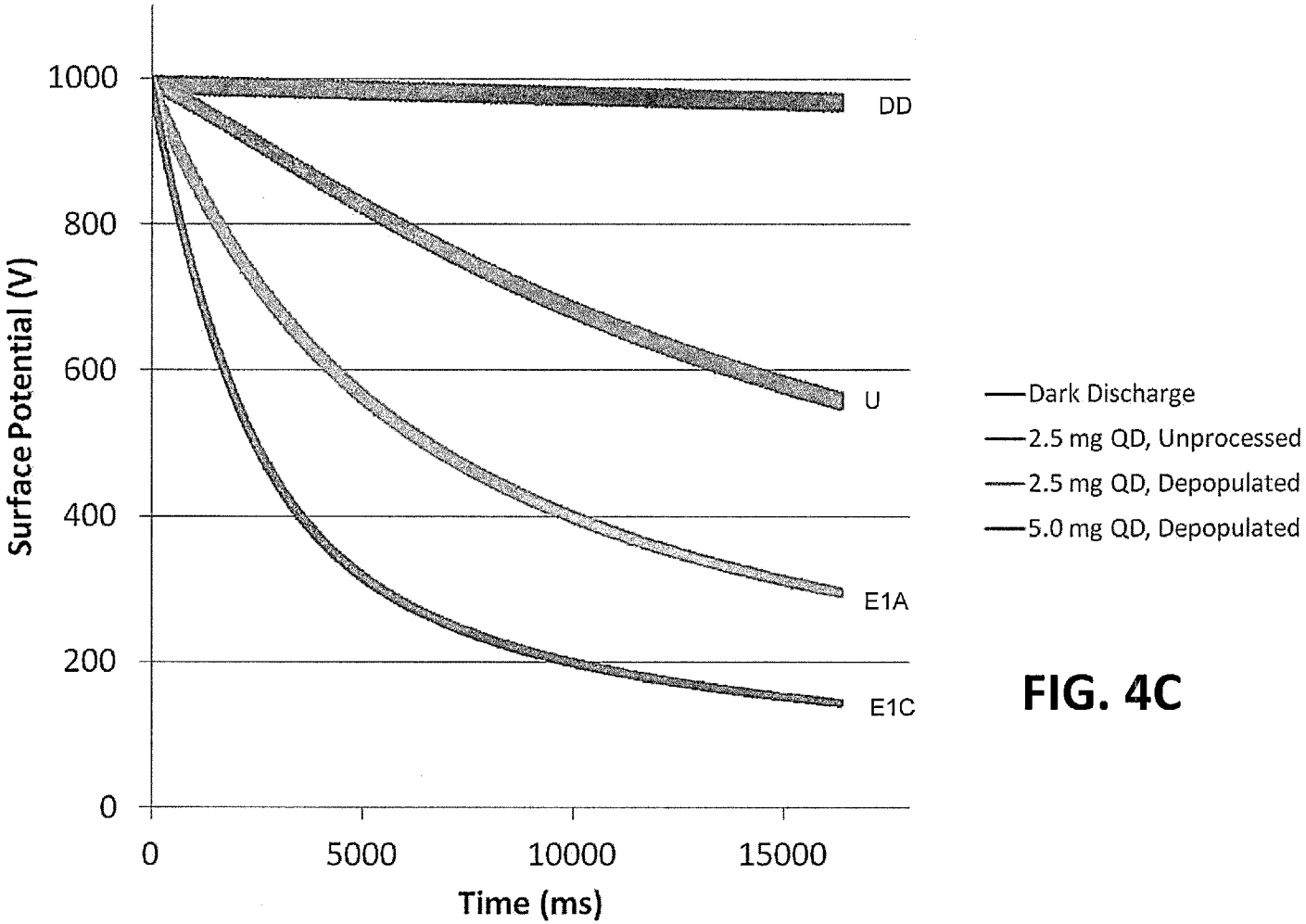
FIG. 4C depicts the PIDC of exemplary comparative devices comprising quantum dots where the capping layer comprises depopulated quantum dots.

FIG. 4C depicts the PIDC of exemplary comparative devices comprising quantum dots where the capping layer comprising depopulated quantum dots for Examples 1A E1A and the device with the unmodified quantum dots U as shown FIGS. 4A and 4B respectively as compared to the device comprising depopulated QDs of Example 1C. Initial surface potential is at +1000 V, and the device was illuminated with 600 nm monochromatic light. As will be noted, Example 1C E1C including 5.0 mg of InP QDs shows an even faster photoresponse than the other exemplary embodiments, dropping to about 300V in about 5 seconds. As will be appreciated, FIG. 4C also shows the Dark Discharge (DD) characteristic of the QDPC, and in particular shows the QDPC has high charge retention during a dark cycle and further shows the strong degree of the rate of the photodischarge when illuminated. A similar Dark Discharge characteristic is shown throughout the following examples.

Example 2

Fabrication of the Exemplary Devices

In an embodiment the exemplary device utilizes quantum dots (with organic capping layer substantially removed) as charge generation material (CGM) via organic ligand exchange of the capping layer and removal of the exchanged capping layer, as for example depicted in FIGS. 2A-2C, through the methodology described for the exemplary devices below.

Modification of the QD's surface is achieved through first, replacement of the initial capping layer with a substantially different capping layer through exchange of long-chain organic ligand forming the initial capping layer with small organic molecules as a final capping layer, and second, substantial removal of the final capping layer from the QDs at elevated temperatures under reduced pressure after the QDPC device has been fabricated.

For the purpose of the disclosed exemplary devices, the initial capping layer was composed of myristic acid ligands, and the final capping layer was composed of pyridine. The QDPC formulation for an exemplary device was prepared by first mixing a 2.5 mg of solid InP QD sample (having myristic acid ligands forming the capping layer) with 0.5 ml of pyridine. The mixture was then placed in a reflux apparatus, and refluxed under flow of argon (providing an inert atmosphere) for a period of 12-40 hours at a temperature of 85-130 degrees Celsius, resulting in exchange of myristic acid ligands with pyridine on the surface of the QDs.

After cooling to room temperature, the volume of the mixture was reduced through vacuum evaporation to remove pyridine to afford a mixture with a total volume of 0.1-0.3 ml. Next, 1.0-3.0 ml of hexane was added to the mixture to induce precipitation of ligand-exchanged quantum dots, the process being carried out in an inert atmosphere. The mixture was subjected to centrifugation at 4000 rpm for 120 minutes, resulting in full separation of solid QD from the supernatant liquid containing excess pyridine, hexane, and myristic acid ligands. The supernatant liquid was then removed from the mixture, affording the solid QD having a pyridine-ligand capping layer. This process of dissolution-precipitation-liquid phase removal may be repeated any number of additional times, using pyridine for dissolving the QD solid and hexane to induce precipitation.

The ligand-exchanged QD solid was mixed with a 0.16 ml solution of N,N'-Diphenyl-N,N' di(3-tolyl)-4-benzidine (TPD) in chloroform (105 mg/ml), and the mixture is stored in the glove box for 5-24 hours to allow full dispersion of QD solids in the liquid phase. Next, 0.29 ml of a 90 mg/ml solution of polystyrene (PS) in chloroform was added to the QD/TPD dispersion and stirred. Additionally, 0.05 ml of chloroform was added to the mixture and stirred, bringing the total volume of chloroform to 0.5 ml thereby providing the QDPC formulation.

As will be appreciated, in each example described herein the total volume of chloroform is 0.5 ml for each QDPC formulation.

To prepare a substrate for QDPC layer deposition, a 75 mm×25 mm×1 mm glass slide was cleaned by ultrasonication in an isopropyl alcohol bath for 60 minutes and dried. A ground electrode was formed on the glass substrate through deposition of a 200 nm layer of aluminum (99.998%) on the glass slide via e-beam evaporation. The aluminum-deposited glass slide was then removed from the evaporator and used for QDPC device fabrication.

The exemplary single-layer QDPC device was fabricated by first depositing a layer of QDPC on the aluminum-coated substrate utilizing the above-mentioned QDPC formulation. QDPC layer deposition was performed through blade-coating to afford an about 20 μm QDPC layer following drying in ambient conditions for 3-24 hours.

Next, the device was placed in a vacuum oven, pressure was reduced to 1-0.001 torr and the sample was heated to 80-200 degrees Celsius for 1-6 hours in order to remove the pyridine from the surface of QDs. The device was then cooled to room temperature.

It was noted that the lamination of the photoconductor following this thermal/vacuum treatment was surprisingly strong and resistant to delaminating, as the formed QDPC device and the QDPC layer had not delaminated for more than six months and showed no signs of doing so. No additional materials beyond those described in the present example had been added to aid lamination.

After cooling to room temperature, the device was placed in a photo-induced discharge measurement apparatus to characterize its performance. Typical photo-induced discharge characterization (PIDC) measurements were performed at an initial surface potentials of +1000V and 750V obtained by charging the QDPC with a Corona charger and illumination at a wavelength of 600 nm using light generation from the light generation components of a Fluorescence spectrometer. Measurements were taken using a detection device including transparent probe and an electrostatic volt meter device coupled to computer software configured for the measurements.

Examples of the exemplary device utilizing quantum dots with modification of the QD's achieved through first, replacement of the initial capping layer with a substantially different capping layer through exchange of long-chain organic ligand forming the initial capping layer with small organic molecules, and second, substantial removal of the final capping layer from the QDs at elevated temperatures under reduced pressure after the QDPC device has been fabricated are given in Table 2.

TABLE 2

Example 2 Ligand Exchange

| | Component Mass (mg) | | | Component Ratio | | |
|---|---|---|---|---|---|---|
| Examples | QD | HTM | Polymer | QD | HTM | Polymer |
| Example 2A E2A | 2.5 | 17 | 26 | 0.055 | 0.374 | 0.571 |
| Example 2B E2B | 5.0 | 22 | 21 | 0.104 | 0.458 | 0.438 |
| Example 2C | 10.0 | 25 | 21 | 0.179 | 0.446 | 0.375 |
| Example 2D | 20.0 | 28 | 25 | 0.274 | 0.384 | 0.342 |
| Example 2E | 20.0 | 42 | 25 | 0.230 | 0.483 | 0.287 |

Embodiments of the QDPC device including InP QDs (having myristic acid ligands forming the capping layer) of 5.0 mg, 10 mg, and 20 mg were also obtained and processed as described above, adjusting for parameters as will be understood by ordinarily skilled artisans possessed of the present disclosure. Namely the QDPC formulations for the exemplary devices were prepared by first mixing the solid with from 0.5 ml to 2.0 ml of pyridine. The mixture was then placed in a reflux apparatus, and refluxed under flow of argon (providing an inert atmosphere) for a period of from 12 to 120 hours at a temperature of 85-130 degrees Celsius, resulting in exchange of myristic acid ligands with pyridine on the surface of the QDs. In exemplary embodiments for 10 mg and 20 mg of QDs, the mixture could be refluxed once for 120 hours or the mixture may be refluxed for a plurality of times, for example twice at 48-72 hours each time.

Fabrication of a Standard Device

A comparative device was fabricated to confirm performance enhancement in the exemplary device. For the standard device, a sample of InP core QD with the same initial characteristics was utilized; however, the QD sample was not subjected to capping layer exchange and removal, and retained its original capping layer. In order to perform a valid comparison between the exemplary and the standard device, all parameters, materials, and mixtures were kept identical. Accordingly, the same amounts of QD, TPD, and PS were used to afford the QDPC formulation for the standard device. The type of substrate and the method for deposition of the QDPC formulation for the standard device remained the same as well. Performance measurements were conducted using the same methodology as the previous example.

Figure 5A:
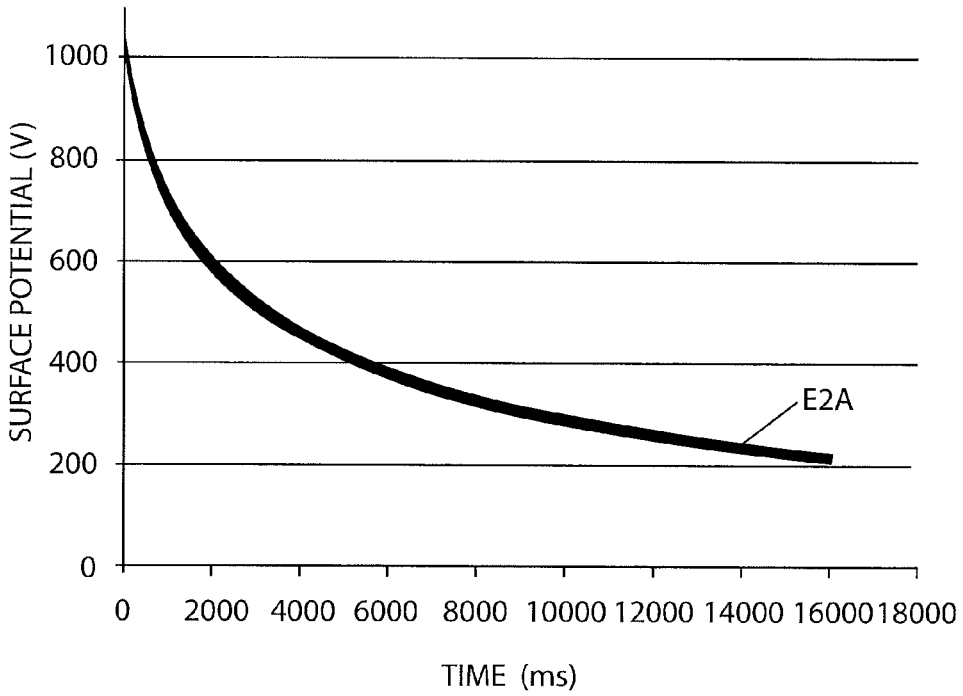
FIGS. 5A and 5B exhibits the photo-induced discharge characteristic (PIDC) of an exemplary device.
Figure 5B:
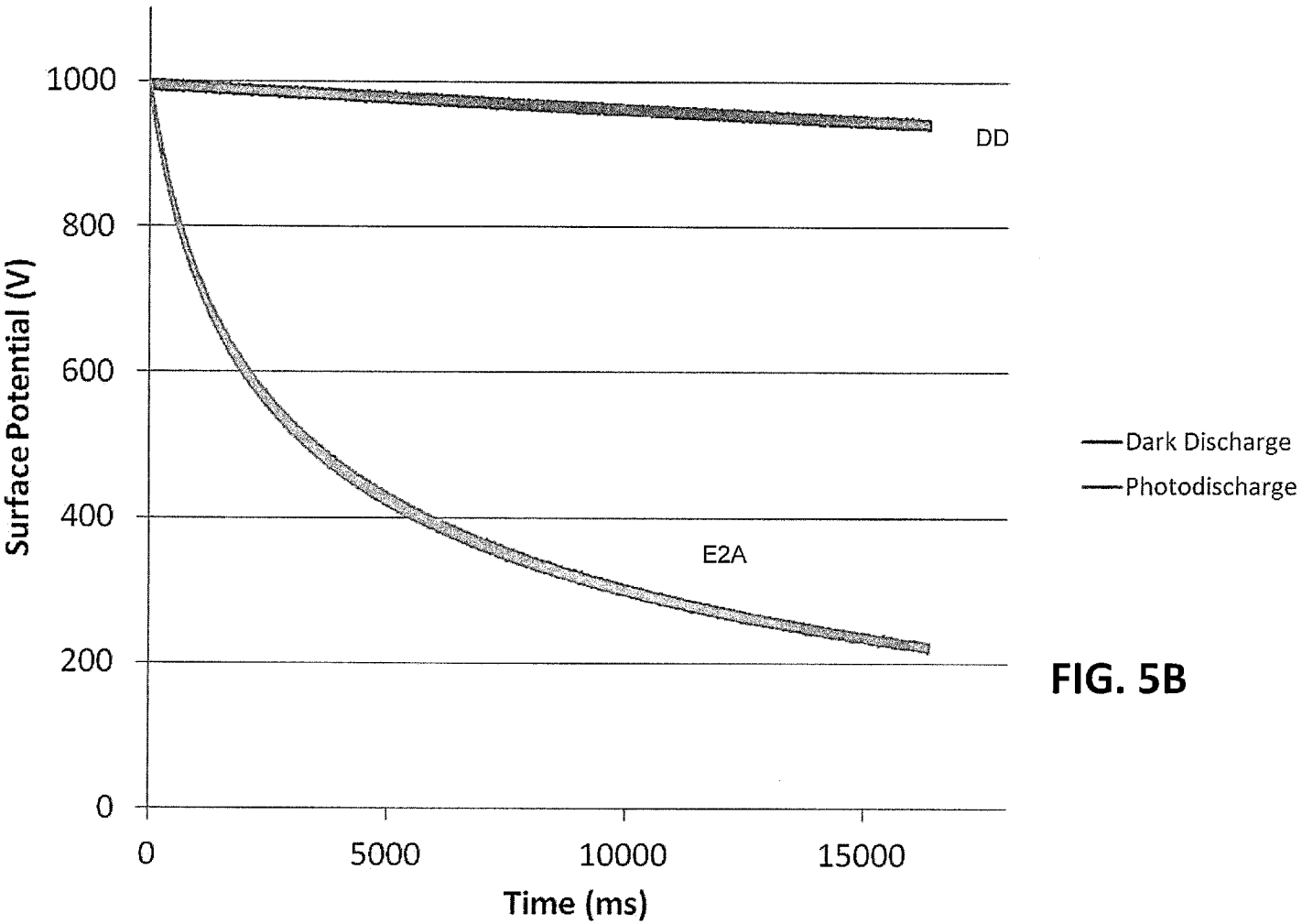

FIGS. 5A and 5B exhibits the photo-induced discharge characteristic (PIDC) of the exemplary device of Example 2A E2A. Initial surface potential was at +1000 V, and the device was illuminated with 600 nm monochromatic light. As will be appreciated, FIG. 5B also shows the Dark Discharge DD characteristic of the QDPC, and in particular shows the QDPC has high charge retention during a dark cycle and further shows the strong degree of the rate of the photodischarge when illuminated. A similar Dark Discharge characteristic is shown throughout the following examples.

Figure 5C:
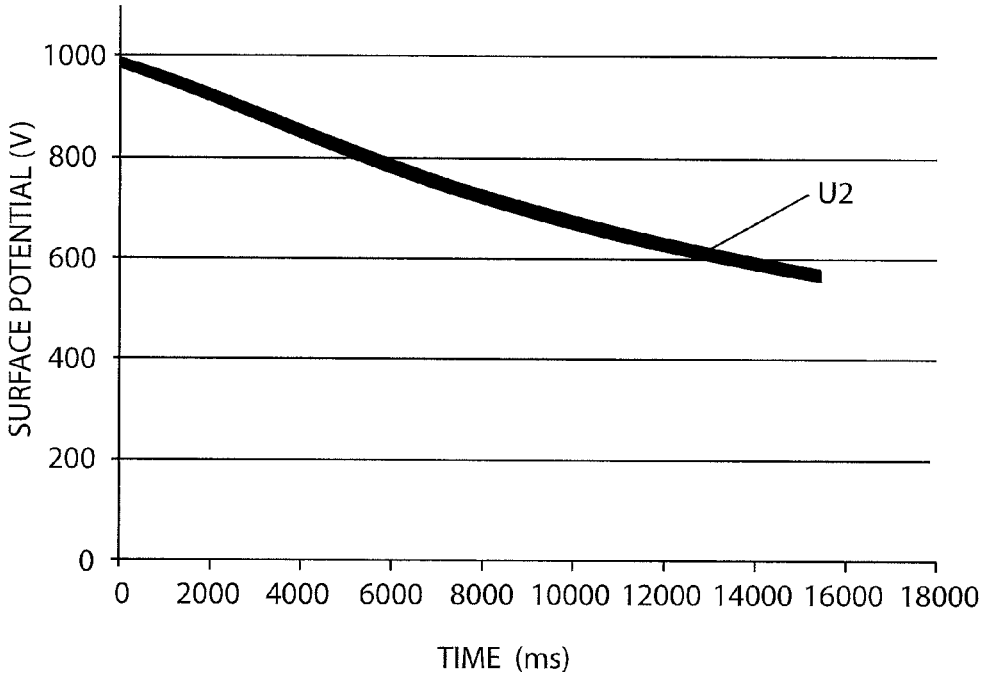
FIG. 5C depicts the PIDC of the device with unmodified quantum dots.

FIG. 5C depicts the PIDC of the device with unmodified quantum dots U2. Initial surface potential was at +1000 V, and the device was illuminated with 600 nm monochromatic light.

Figure 5D:
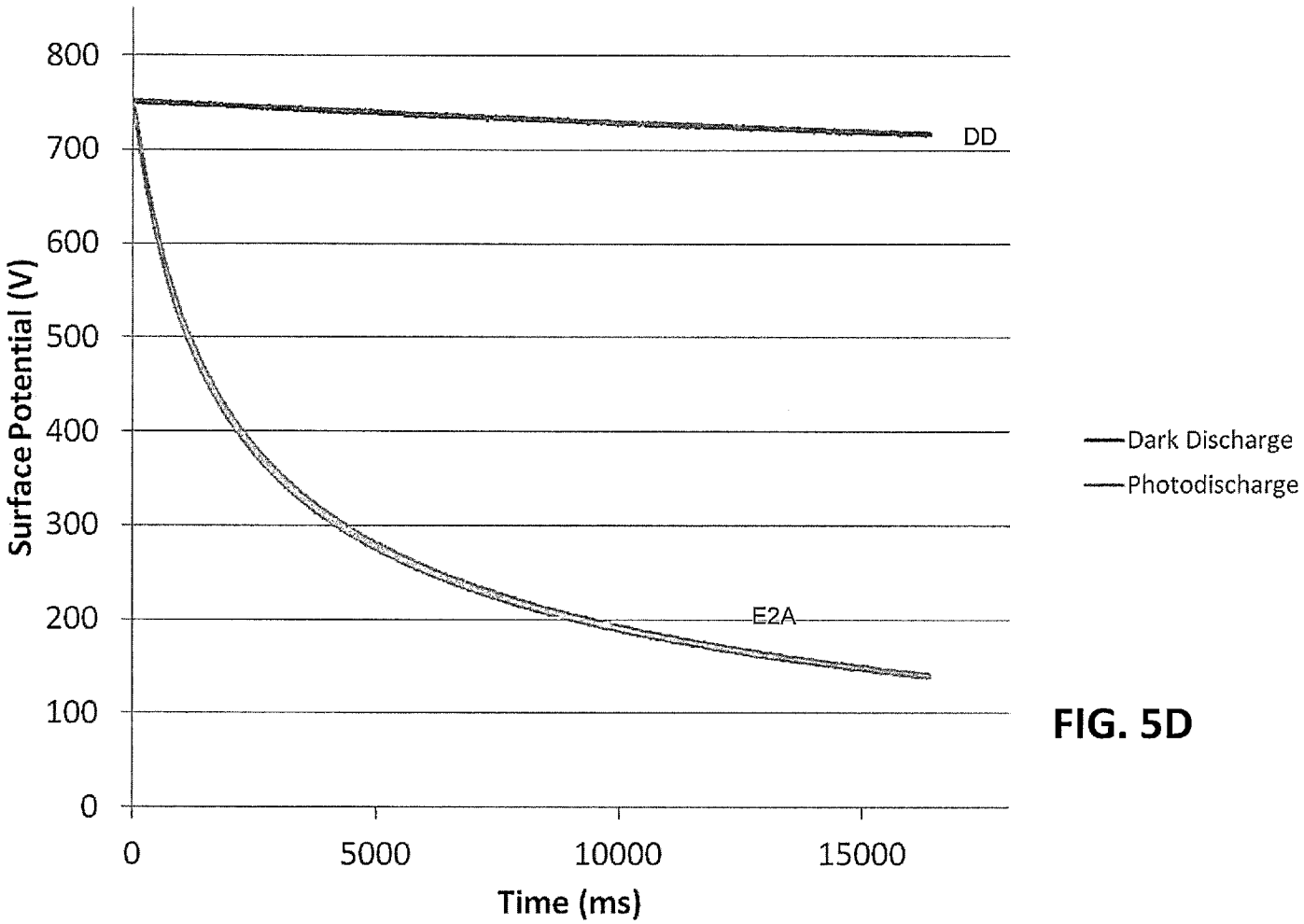
FIG. 5D exhibits the photo-induced discharge characteristic (PIDC) of an exemplary device.

FIG. 5D exhibits the photo-induced discharge characteristic (PIDC) of the exemplary device of Example 2A E2A. Initial surface potential was at +750 V, and the device was illuminated with 600 nm monochromatic light.

Figure 6A:
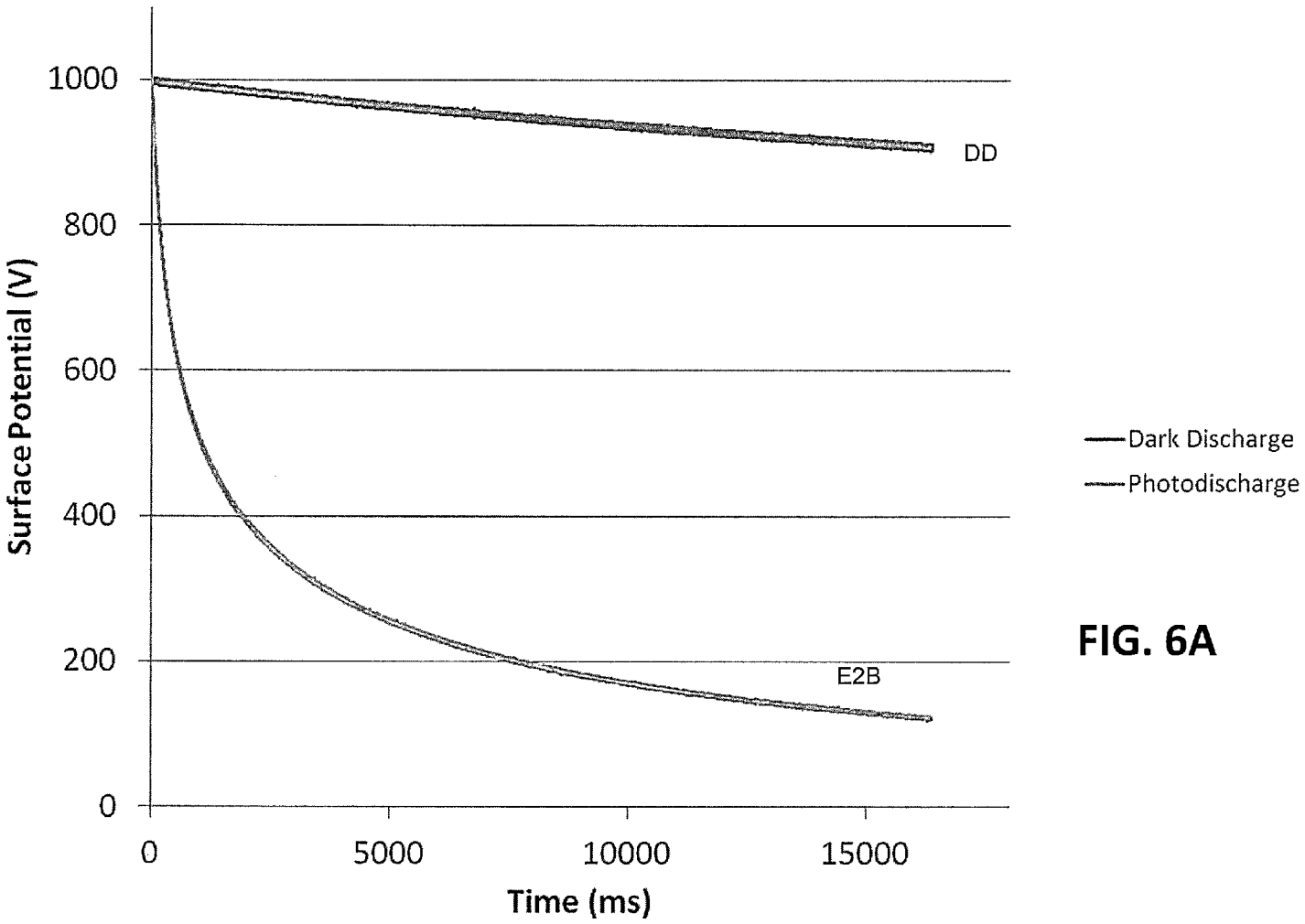
FIG. 6A exhibits the photo-induced discharge characteristic (PIDC) of an exemplary device.

FIG. 6A exhibits the photo-induced discharge characteristic (PIDC) of the exemplary device of Example 2B E2B, where the device includes 5.0 mg of the modified QDs. Initial surface potential was at +1000 V, and the device was illuminated with 600 nm monochromatic light.

Figure 6B:
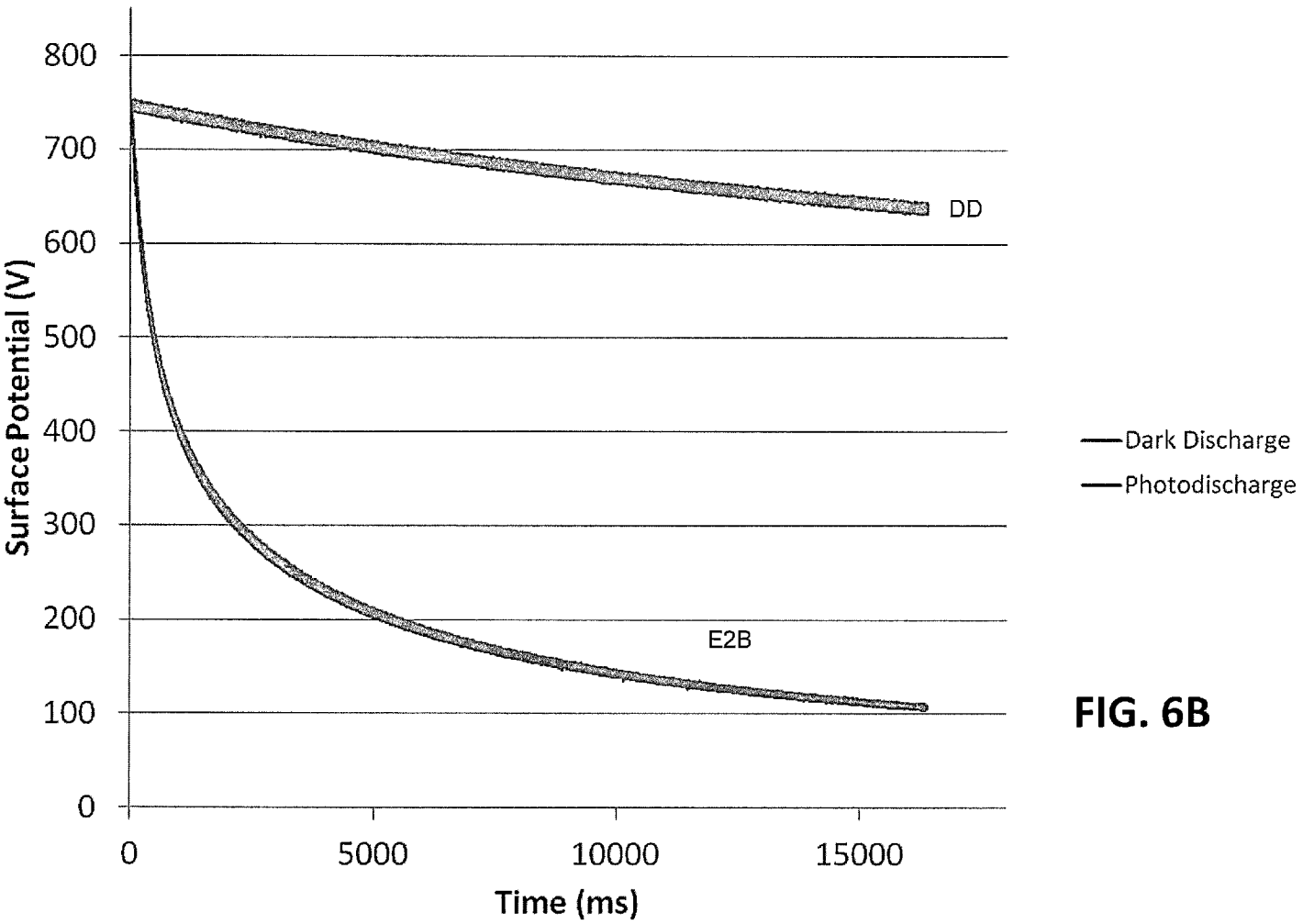
FIG. 6B exhibits the photo-induced discharge characteristic (PIDC) of an exemplary device.

FIG. 6B exhibits the photo-induced discharge characteristic (PIDC) of the exemplary device of Example 2B E2B. Initial surface potential is at +750 V, and the device was illuminated with 600 nm monochromatic light.

Figure 6C:
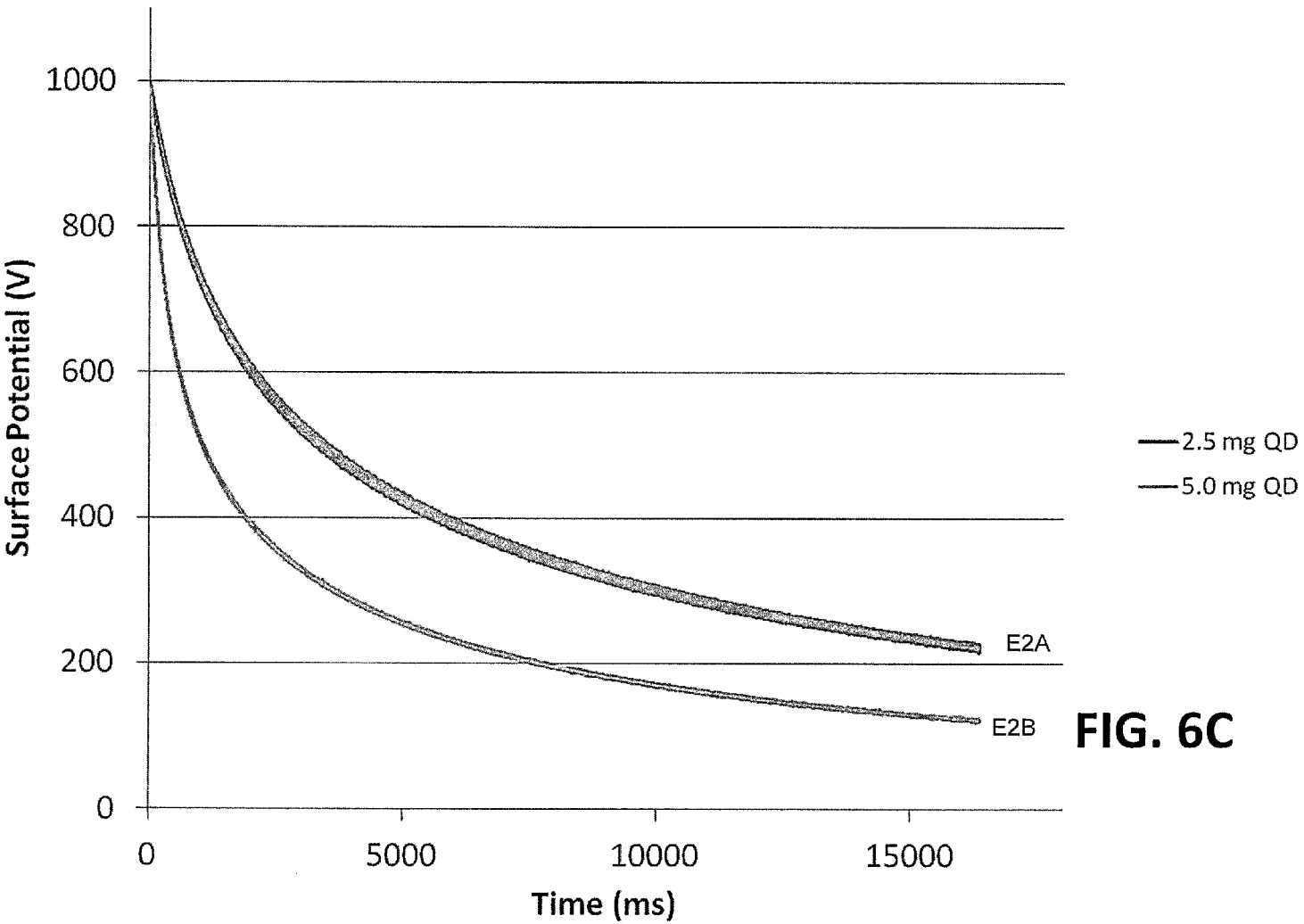
FIG. 6C exhibits a comparison between the Examples.

FIG. 6C exhibits a comparison between the Examples 2A E2A and 2B E2B, which shows that the 5.0 mg concentration of QDs of Example 2B E2B exhibited a 3.2 times increase in photodischarge rate at ½ the initial surface potential over that of the 2.5 mg of QD of Example 2A E2A. The decrease in residual potential of Example 2A over 2B was about 100V.

Figure 7A:
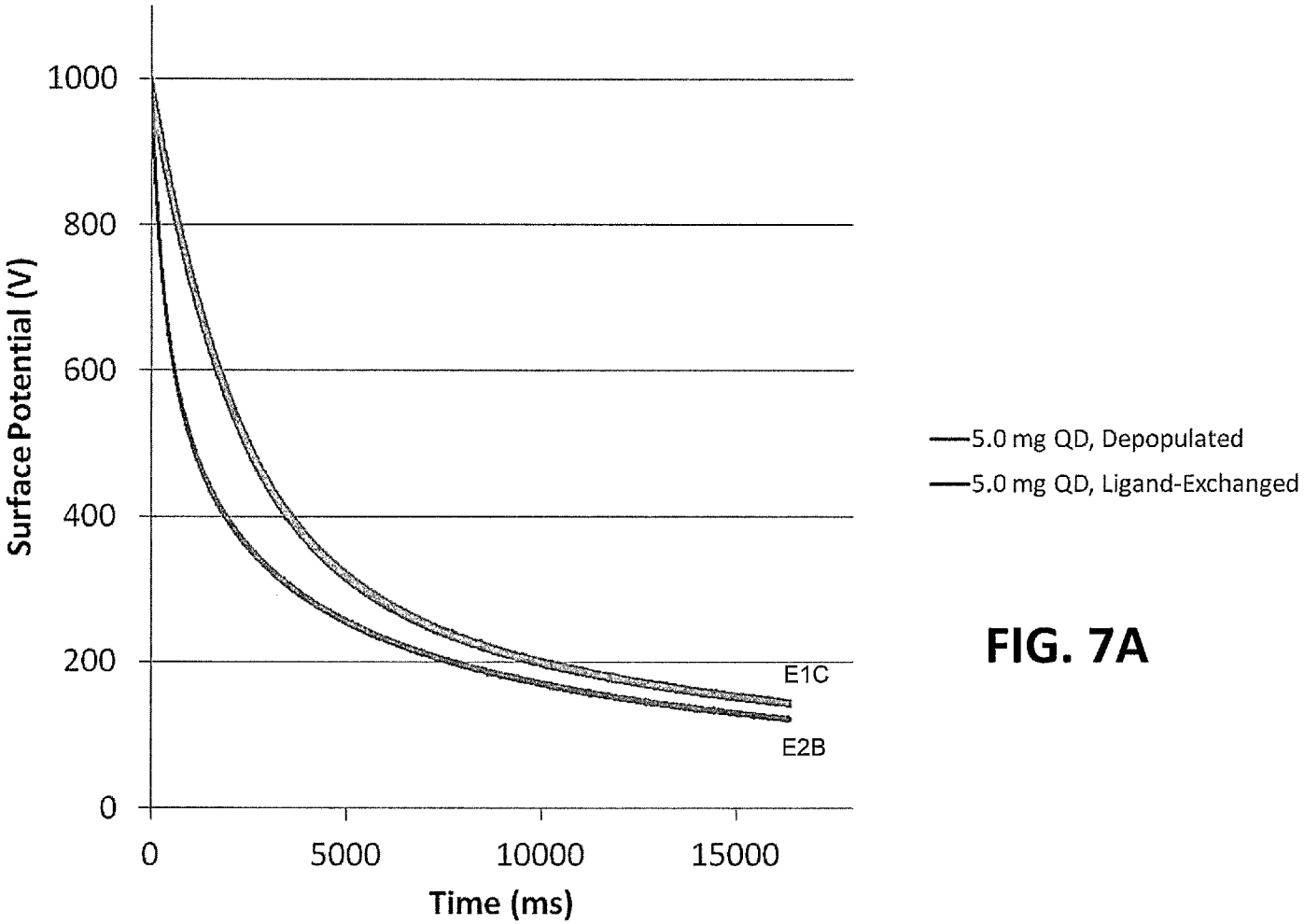
FIG. 7A exhibits a comparison between the Examples.

FIG. 7A exhibits a comparison between the Example 2B E2B and Example 1C E1C, which shows that the 5.0 mg concentration of QDs of Example 2A (ligand-exchanged and processed thermally under vacuum) exhibited a 2.3 times increase in photodischarge rate at ½ the initial surface potential over that of the 5.0 mg of QD of Example 1A (depopulated via solvent processing as described in Example 1). The decrease in residual potential of Example 2B E2B over 1C E1C was about 25V. In each case, initial surface potential was charged to +1000 V, and the device was illuminated with 600 nm monochromatic light.

Figure 7B:
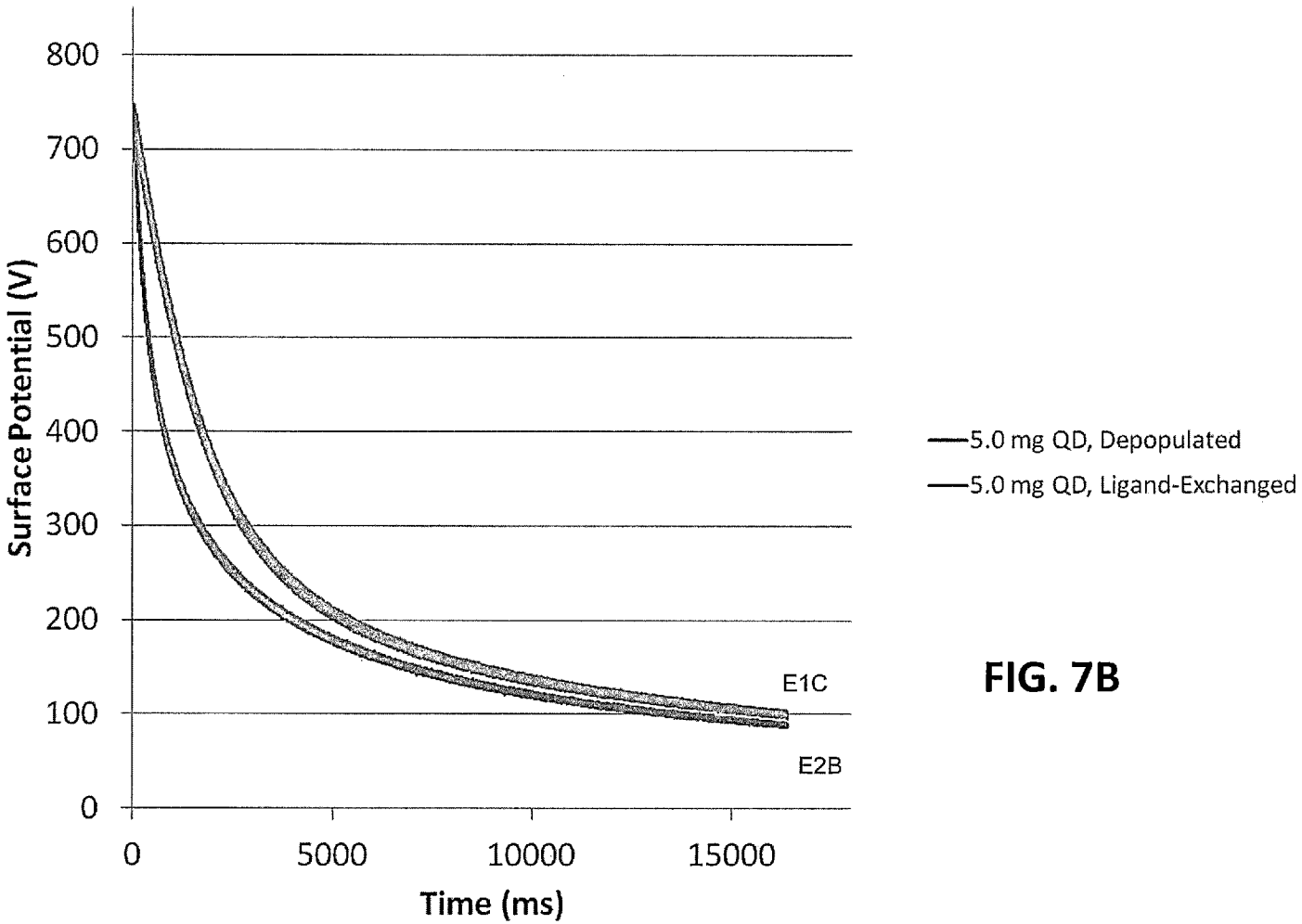
FIG. 7B exhibits a comparison between the Examples.

FIG. 7B exhibits a comparison between the Example 2B E2B and Example 1C E1C where the initial surface potential was charged to +750 V, and the device was illuminated with 600 nm monochromatic light. The 5.0 mg concentration of QDs of Example 2A E2A (ligand-exchanged and processed thermally under vacuum) exhibited a 2.1 times increase in photodischarge rate at ½ the initial surface potential over that of the 5.0 mg of QD of Example 1A E1C (depopulated via solvent processing as described in Example 1).

Figure 7C:
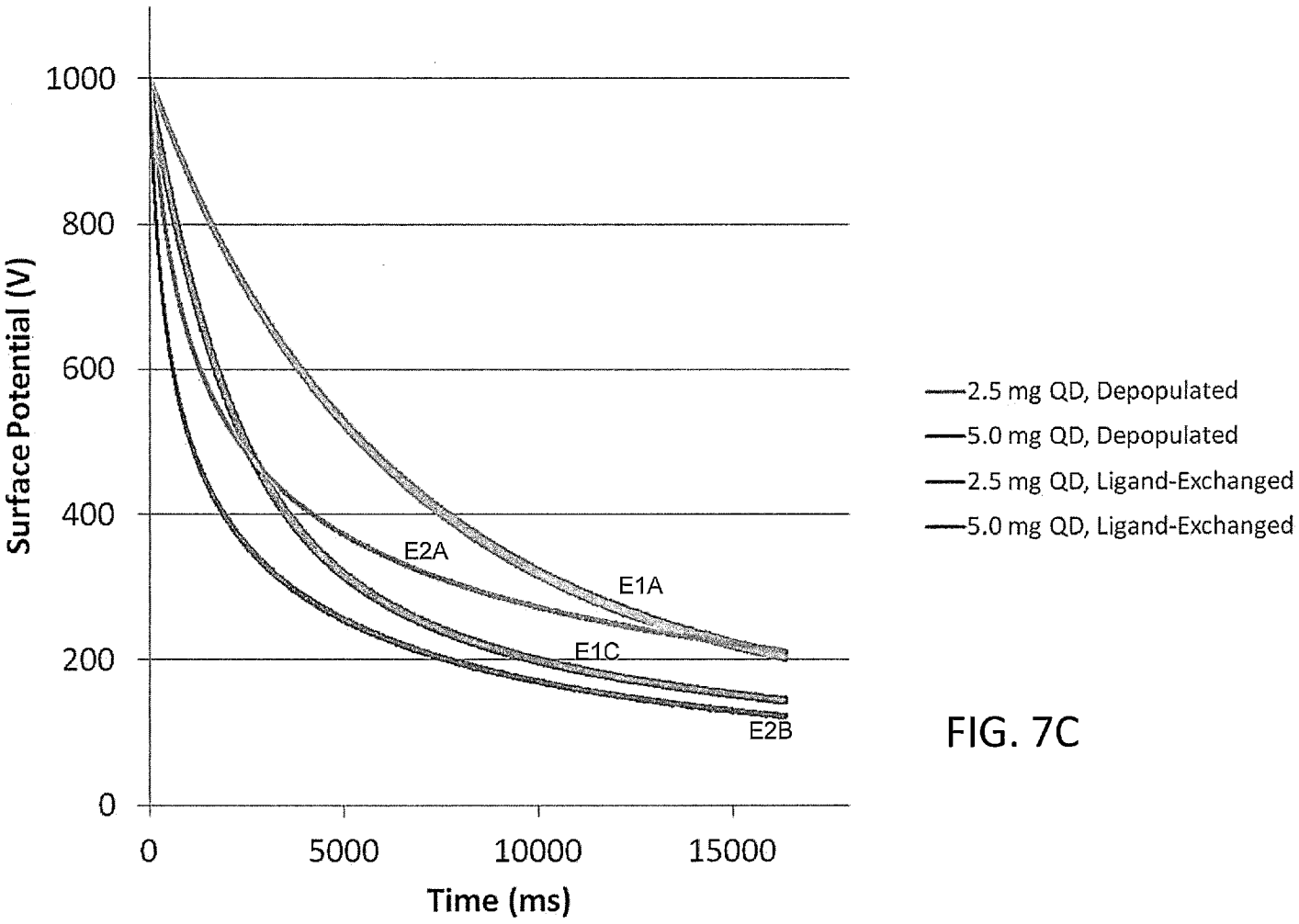
FIG. 7C exhibits a comparison between the Examples.

FIG. 7C exhibits a comparison between the Example 1A E1A, Example 1C E1C (depopulated) Example 2A E2A and Example 2B E2B (ligand exchanged), where the initial surface potential was charged to +1000 V, and the device was illuminated with 600 nm monochromatic light.

Example 3

Example 3 illustrates an embodiment including an exemplary dual layer QDPC device. A CGM formulation comprising ligand-free quantum dots was dispersed in a solvent. The removal of ligands is achieved through replacement of the initial capping layer with a substantially different capping layer through exchange of long-chain organic ligand forming the initial capping layer with small organic molecules as a final capping layer, and then substantial removal of the final capping layer from the QDs at elevated temperatures under reduced pressure after the QDPC device has been fabricated, as for example depicted in FIGS. 2A-2C, through the methodology described for the exemplary devices below.

The initial capping layer was composed of myristic acid ligands, and the final capping layer was composed of pyridine. The QD solid of the exemplary device was prepared by first mixing 10 mg of solid InP QD solids (having myristic acid ligands forming the capping layer) with 2.0 ml of pyridine. The mixture was then placed in a reflux apparatus, and refluxed under flow of argon (providing an inert atmosphere) for a period of 12-72 hours at a temperature of 85 135 degrees Celsius, resulting in exchange of myristic acid ligands with pyridine on the surface of the QDs.

After cooling to room temperature, the volume of the mixture was reduced through vacuum evaporation of pyridine to afford a mixture with a total volume of 0.1 0.3 ml. Next 1.0 2.0 ml of hexane was added to the refluxed mixture to induce the precipitation of ligand-exchanged quantum dots, the process being carried out in an inert gas atmosphere. The mixture was subjected to centrifugation at 4000 rpm for 60-120 minutes, resulting in the full separation of solid QDs from the supernatant liquid containing excess pyridine, hexane, and myristic acid ligands. The supernatant liquid was then removed from the mixture, affording the solid QD having a pyridine ligand capping layer. The process of dissolution-precipitation-liquid phase removal may be repeated additional times, using pyridine for dissolving the QD solid and hexane to induce precipitation. For example, in the present example, this process was repeated one additional time to remove any remaining unbound myristic acid. The resulting solid QD sample was dissolved in 0.4 ml of chloroform to afford a 25 mg/ml solution and stored in a glove box filled with an inert gas.

To prepare the CTM formulation for the CTL, solutions of N,N'-Diphenyl-N,N'-di(3-tolyl)-4-benzidine (TPD) in chloroform (105 mg/ml) and polystyrene (PS) in chloroform (90 mg/ml) were separately prepared. Final CTM formulation was prepared by combining appropriate amounts of the two solutions to afford a mixture such that the TPD solid content has a range of 30-60% by weight, most preferably 46%, with respect to the total (TPD+PS) solid content.

To prepare a substrate for QDPC layer deposition, a 75 mm×25 mm×1 mm glass slide was cleaned by an ultrasonic machine in an isopropyl alcohol bath for 60 minutes and then dried. A ground electrode was formed on the glass substrate through deposition of a 200 nm layer of aluminum (99.998%) on the glass slide via e-beam evaporation. The aluminum-deposited glass slide was then removed from the evaporator and used for the QDPC device fabrication.

An exemplary dual layer QDPC device was fabricated by first depositing the CGL on the aluminum-coated substrate utilizing the above-mentioned CGL formulation. The CGL layer deposition may be performed through drop-casting, spin coating, or blade-coating to afford a CGL layer thickness in the range of about 20 1,000 nm following drying in ambient conditions for 1-6 hours. The device has approximately a 200 nm thick CGL layer. Next, the device was placed in a vacuum oven, whose pressure was reduced to 1-0.001 torr and the sample was heated to 80 200 degrees Celsius for 1-6 hours in order to remove the pyridine from the surface of QDs. After cooled to room temperature, the CTL was deposited over the as-prepared CGL through blade-coating of the above-mentioned CTM formulation to afford a CTL thickness of about 5-35 μm, preferably 20 μm, after solvent evaporation in ambient conditions for 1-24 hours. To ensure good continuity to the ground plane, a copper tape was attached onto a section of the bare aluminum layer on the substrate.

To determine device performance, the device was placed in a photo-induced discharge measurement apparatus. Typical photo-induced discharge (PID) measurements were performed at an initial surface potential of −750 V and illumination wavelength of 600 nm.

Figure 8:
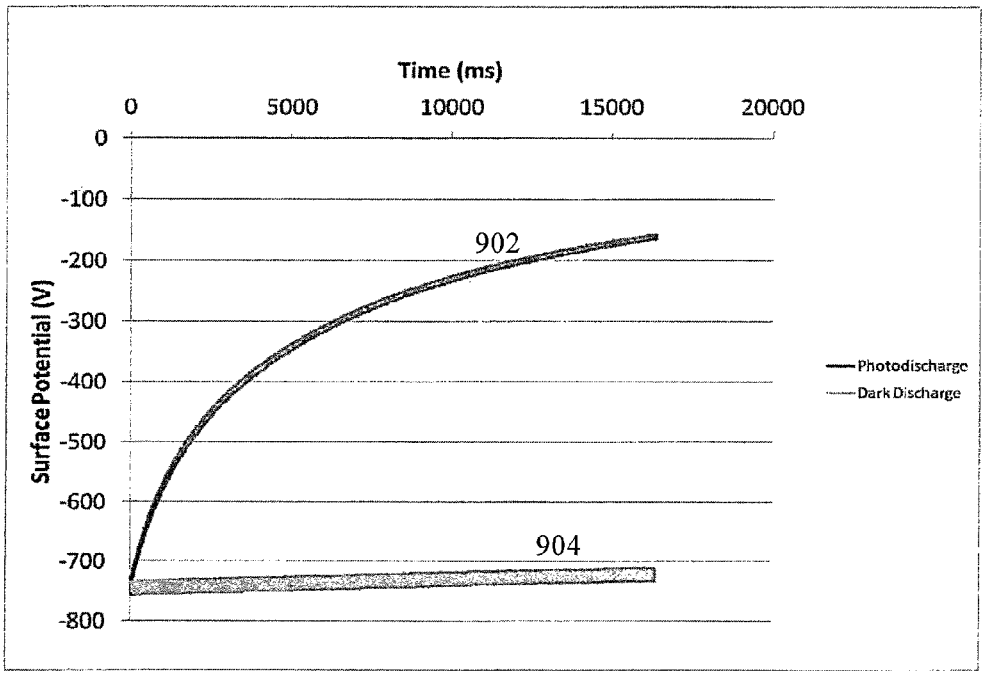
FIG. 8 exhibits a photo-induced discharge (PID) and dark discharge characteristics of a device as disclosed in Example 3. Initial surface potential is at −750 V, and the device was illuminated with 600 nm monochromatic light.

FIG. 8 compares the photo-induced discharge characteristic 902 and a dark discharge characteristic 904 of Example 3. The vertical axis represents the surface potential of the substrate, and the horizontal axis represents time.

Example 4

Example 4 illustrates an embodiment including an exemplary dual layer QDPC device. A CGM formulation comprising ligand free quantum dots was dispersed in a solvent and a polymer dissolved in the same solvent or a different solvent. Preparation of the ligand free QD solids is achieved through the same process as described in Example 3. The final CGM formulation was prepared through mixing of InP QD dispersion in chloroform with polystyrene polymer dissolved in chloroform to afford a 0.5 ml mixture with QD solid content range of 30-90% (50% for Example 4) with respect to total (InP+PS) solid content.

To prepare the CTM formulation for the CTL, solutions of NN' Diphenyl N,N' di(3-tolyl)-4-benzidine (TPD) in chloroform (105 mg/ml) and polystyrene (PS) in chloroform (90 mg/ml) were separately prepared. Final CTM formulation was prepared by combining appropriate amounts of the two solutions to afford a 0.5 ml mixture with a TPD solid content range of 30-60% by weight, preferably 46%, with respect to total (TPD+PS) solid content.

To prepare a substrate for QDPC layer deposition, a 75 mm×25 mm×1 mm glass slide was cleaned by an ultrasonic machine in an isopropyl alcohol bath for 60 minutes and then dried. A ground electrode was formed on the glass substrate through deposition of a 200 nm layer of aluminum (99.998%) on the glass slide via e-beam evaporation. The aluminum-deposited glass slide was then removed from the evaporator and used for the QDPC device fabrication.

An exemplary dual layer QDPC device for Example 4 was fabricated by first depositing the CGL on the aluminum-coated substrate utilizing the above-mentioned CGL formulation. CGL layer deposition may be performed through drop-casting, spin coating, or blade-coating to afford a CGL layer thickness in the range of 200-10,000 nm (about 8,000 nm for Example 4), following drying in ambient conditions for 1-6 hours. Next, the device was placed in a vacuum oven whose pressure was reduced to 0.01 0.001 torr and the sample was heated to 80 200 degrees Celsius for 1-6 hours in order to remove the pyridine from the surface of QDs. After cooled to room temperature, the CTL was deposited over the as-prepared CGL through blade-coating of the above-mentioned CTM formulation to afford a CTL thickness of about 5-35 μm, preferably 20 μm, following solvent evaporation in ambient conditions for 1-24 hours. To ensure good continuity to the ground plane, a copper tape was attached onto a section of the bare aluminum layer on the substrate.

To determine device performance, the exemplary device was placed in a photo-induced discharge measurement apparatus. Typical photo-induced discharge (PID) measurements were performed at an initial surface potential of −750 V and illumination wavelength of 600 nm.

Figure 9:
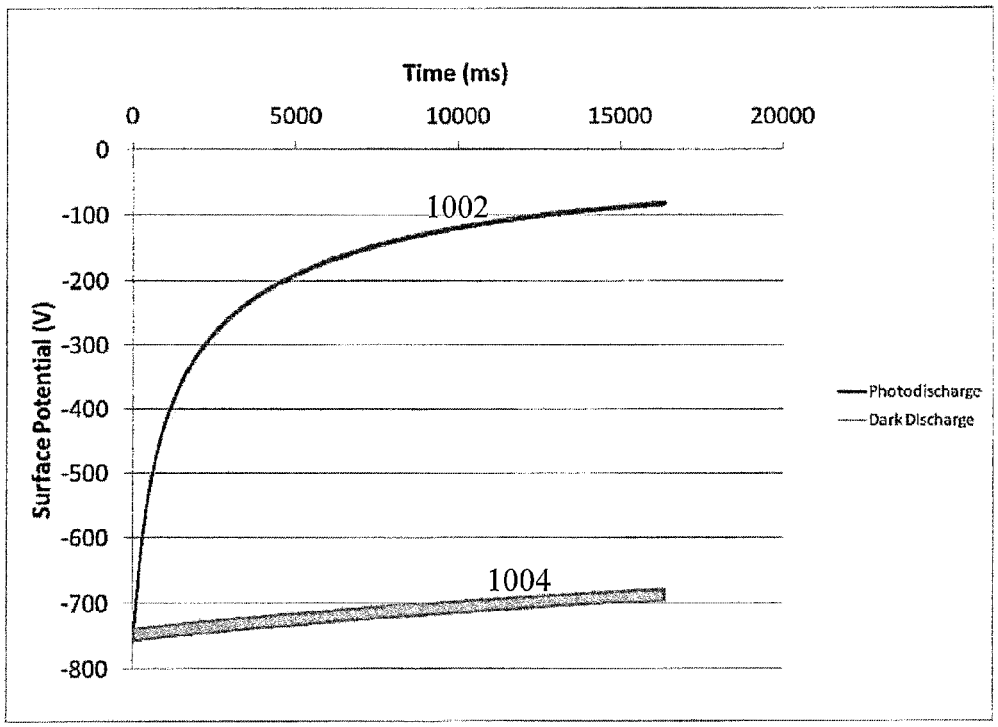
FIG. 9 exhibits a photo-induced discharge (PID) and dark discharge characteristics of a device as disclosed in Example 4. Initial surface potential is at −750 V, and the device was illuminated with 600 nm monochromatic light.

FIG. 9 compares the photo-induced discharge characteristic 1002 and a Dark Discharge characteristic 1004 of Example 4.

Although exemplary embodiments of the present invention and modifications thereof have been described in detail herein, it is to be understood that this invention is not limited to these precise embodiments and modifications, and that other modifications and variations may be effected by one skilled in the art without departing from the spirit and scope of the invention as defined by the appended claims.

What is claimed is:

1. A quantum dot photoconductor (QDPC) for an electrophotographic device comprising:

at least one conductive layer and an active region comprising at least one photoconductor layer comprising:

a charge generation material (CGM) comprising a plurality of surface modified quantum dots (QD), wherein the quantum dots are formed by:

replacement of an initial capping layer with a substantially different capping layer through exchange of long-chain organic ligand forming the initial capping layer with small organic molecules; and substantial removal of the final capping layer from the QDs at elevated temperatures under reduced pressure after the QDPC device for the electrophotographic device has been fabricated.

2. The photoconductor of claim 1;

wherein the quantum dots comprise at least one quantum dot selected from the group consisting of size-dependent quantum dots, composition-dependent quantum dots, core-shell quantum dots, alloyed core quantum dots, alloyed core-shell quantum dots, doped quantum dots, InP/ZnS core-shell quantum dots, CdS, CdSe, ZnS, ZnSe, GaN, GaP, InP, InN, PbSe, PbS, Ge, CuI, Copper Indium Gallium Disulfide (GIGS), Si, CdSSe, and ZnS:Mn doped quantum dots.

3. The photoconductor of claim 1;

wherein the conductive layer comprises at least one conductive substrate selected from the group consisting of aluminum plates and cylinders, a non-conductive substrate coated with a conductive material, aluminum-coated Mylar or PET, and nickel-coated Mylar or PET.

4. The photoconductor of claim 3;

wherein the conductive layer comprises aluminum.

5. A method of forming the QDPC according to claim 1, comprising:

replacing an initial capping layer of quantum dots (QDs) with a substantially different final capping layer through an exchange of long-chain organic ligands forming the initial QD capping layer with small organic molecules;

removing substantially all of the final capping layer from the QDs at elevated temperatures under reduced pressure after the QDPC device for the electrophotographic device has been fabricated; and preparing a charge generation material for the QDPC including the QDs having the capping layer removed.

6. The method of claim 5, further comprising:

dissolving a QD sample comprising the QDs with the initial capping layer in a solvent to form a QD solution, wherein the solvent comprises smaller ligands than the ligands forming the initial capping layer;

refluxing the QD solution;

precipitating the refluxed QD solution with a precipitant to the to induce precipitation of ligand-exchanged quantum dots; and separating and removing a liquid phase supernatant liquid including the excess ligands from the refluxed QD solution to afford a QD solid wherein the QDs include the final small-ligand capping layer.

7. The method of claim 6, further comprising:

repeating the dissolution, precipitation, and liquid phase removal a plurality of times.

8. The method of claim 6;

wherein the solvent for dissolving the QD solid comprises pyridine; and wherein the precipitant comprises hexane.

9. The method of claim 6, further comprising:

adding a solution of N,N'-Diphenyl-N,N1-di(3-tolyl)-4-benzidine (TPD) to the ligand-exchanged QD solid to form a QD/TPD dispersion; and adding a polymer to the QD/TPD dispersion to form the QDPC photoconductor material.

10. The method of claim 5, further comprising:

preparing a QDPC formulation by mixing QD sample including long-chain ligands forming the capping layer with the pyridine; and placing the QD mixture in a reflux apparatus and refluxing the QD mixture under a flow of argon for a period of 12-120 hours at a temperature of 85-130 degrees Celsius;

whereby the initial long-chain ligands are exchanged with the final capping layer including small organic ligands on the surface of the QDs.

11. The method of claim 5, wherein:

the QD sample includes InP QD;

the initial capping layer comprises myristic acid ligands; and the final capping layer comprises pyridine.

12. The method of claim 10, wherein:

the QD sample includes InP QD;

the initial capping layer comprises myristic acid ligands; and the final capping layer comprises pyridine.

13. The method of claim 5, further comprising:

preparing a substrate for QDPC layer deposition;

forming a ground electrode on the substrate;

depositing a layer of QDPC material on the substrate; and drying the substrate.

14. The method of claim 13;

wherein depositing the QDPC further comprises:

dispersing the ligand exchanged QD solid with a solution of N,N'-Diphenyl-N,N'-di(3-tolyl)-4-benzidine (TPD); and adding a polymer to the QD/TPD dispersion.

15. The method of claim 13;

wherein the substrate comprising aluminum.

16. The method of claim 6, further comprising:

refluxing the QD solution in an inert atmosphere.

17. The method of claim 14;

wherein the polymer comprises polystyrene.

18. The method of claim 3;

wherein the QDPC material comprises at least 2.5 mg of QD solid.

19. The method of claim 18;

wherein the QDPC material comprises at least from 2.5 mg of QD solid to about 20 mg QD solid.

20. The QDPC of claim 1, further comprising:

an active region comprising at least two photoconductor layers comprising a Charge Generation Layer (CGL) and a Charge Transport Layer (CTL); and a charge generation material (CGM) comprising the plurality of substantially ligand-free quantum dots;

wherein the Charge Transport Layer (CTL) comprises a Charge Transport Material (CTM).

21. The QDPC of claim 20, further comprising:

a polymeric material comprising a polymer matrix or resin or both;

wherein the QDPC is formed with at least one solution of the polymeric material comprising the polymer matrix or resin or both, the solution further including at least one of the CGM or the CTM.

22. The QDPC of claim 21;

wherein the polymeric material includes the CTM.

23. The QDPC of claim 22;

wherein the CGL is substantially free of polymers.

24. The QDPC of claim 22;

wherein the CTM is formed by dissolving a Hole Transport Material (HTM) in a solution of the polymeric material.

25. The QDPC of claim 1, further comprising:

an under coat layer (UCL) for eliminating charge injection from the conductive substrate.

26. The QDPC of claim 23;

wherein the CGL has a thickness of about 20 nm to about 1,000 nm.

27. The QDPC of claim 26;

wherein the CGL has a thickness of about 200 nm.

28. The QDPC of claim 20;

wherein the CTL has a thickness of about 5 μm to about 35 μm.

29. The QDPC of claim 28;

wherein the CTL has a thickness of about 20 μm.

30. The QDPC of claim 20;

wherein the CGL includes polymeric material.

31. The QDPC of claim 30;

wherein the CGL has a thickness of about 200 nm to about 10,000 nm.

32. The QDPC of claim 31;

wherein the CGL has a thickness of about 8000 nm.

33. The photoconductor device of claim 31;

wherein the CTL has a thickness of about 5 μm to about 35 μm.

34. The photoconductor device of claim 33;

wherein the CTL has a thickness of about 20 μm.

35. The method of claim 5, further comprising:

forming a Charge Generation Layer (CGL) comprising the QDs; and forming a Charge Transport Layer (CTL) comprising a Charge Transport Material (CTM).

36. The method of claim 35;

wherein CGL is formed from a polymer-free charge generation material (CGM) solution.

37. The method of claim 35, further comprising:

forming the photoconductor with at least one solution of polymeric material comprising a polymer matrix or resin or both, the solution including at least one of the CGM or the CTM.

38. The method of claim 37, further comprising:

forming the CTM by dissolving a Hole Transport Material (HTM) in a solution of the polymeric material.

39. The method of claim 35, further comprising:

forming the photoconductor with at least one solution of polymeric material comprising a polymer matrix or resin or both, the solution further including the CGM.

* * * * *